US010883689B2

(12) United States Patent
Kuwata et al.

(10) Patent No.: US 10,883,689 B2
(45) Date of Patent: Jan. 5, 2021

(54) VEHICULAR HEADLAMP

(71) Applicant: HONDA MOTOR CO., LTD., Tokyo (JP)

(72) Inventors: Muneharu Kuwata, Tokyo (JP); Masashige Suwa, Tokyo (JP); Naoki Sawai, Tokyo (JP); Ryoto Adachi, Tokyo (JP); Naoto Inoue, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/471,160

(22) PCT Filed: Dec. 22, 2016

(86) PCT No.: PCT/JP2016/088443

§ 371 (c)(1),
(2) Date: Jun. 19, 2019

(87) PCT Pub. No.: WO2018/116454

PCT Pub. Date: Jun. 28, 2018

(65) Prior Publication Data

US 2019/0331309 A1 Oct. 31, 2019

(51) Int. Cl.
*F21S 41/24* (2018.01)

(52) U.S. Cl.
CPC ..... *F21S 41/24* (2018.01)

(58) Field of Classification Search
CPC ..... F21S 41/141; F21S 41/24; F21S 41/63
See application file for complete search history.

(56) References Cited

U.S. PATENT DOCUMENTS

| | | | | |
|---|---|---|---|---|
| 10,018,341 | B2 * | 7/2018 | Madril | F21V 3/02 |
| 10,260,697 | B2 * | 4/2019 | Yamamoto | F21S 41/148 |
| 2013/0021815 | A1 * | 1/2013 | Koizumi | F21S 43/26 362/511 |

(Continued)

FOREIGN PATENT DOCUMENTS

| | | |
|---|---|---|
| EP | 2 567 867 | 3/2013 |
| JP | 2013-054993 | 3/2013 |

(Continued)

OTHER PUBLICATIONS

International Search Report dated Mar. 21, 2017 (Mar. 21, 2017), Application No. PCT/JP2016/088443, 3 pages.

*Primary Examiner* — Leah Simone Macchiarolo
(74) *Attorney, Agent, or Firm* — Rankin, Hill & Clark LLP

(57) ABSTRACT

The left headlamp (100L) includes first light source modules (13L, 14L, and 15L) and a light guide member (16L). The first light source modules (13L, 14L, and 15L) corresponds to partial light distributing patterns (P1L, P2L, and P3L) and have light projection directions parallel to each other. The light guide member (16L) has: first incident surfaces (17L, 18L, and 19L), arranged so as to face the first light source modules (13L, 14L, and 15L) and corresponding to the first light source modules (13L, 14L, and 15L); and an emitting surface (20L), arranged so as to face the first incident surfaces (17L, 18L, and 19L) and shared by the first light source modules (13L, 14L, and 15L). The light guide member (16L) forms a light distributing pattern (PL) by deflecting light projected by the first light source modules (13L, 14L, and 15L).

6 Claims, 21 Drawing Sheets

(56) References Cited

U.S. PATENT DOCUMENTS

| | | | | |
|---|---|---|---|---|
| 2014/0321141 | A1* | 10/2014 | Bauer | F21S 41/30<br>362/511 |
| 2015/0252975 | A1 | 9/2015 | Nakada | |
| 2016/0312970 | A1* | 10/2016 | Suwa | F21S 41/663 |
| 2017/0089536 | A1* | 3/2017 | Courcier | F21S 41/143 |
| 2018/0356060 | A1* | 12/2018 | Kasano | F21S 41/322 |
| 2019/0322209 | A1* | 10/2019 | Sugiyama | B60Q 1/38 |

FOREIGN PATENT DOCUMENTS

| | | |
|---|---|---|
| JP | 2014-127329 | 7/2014 |
| JP | 2015-112969 | 6/2015 |
| JP | 2015-170423 | 9/2015 |

* cited by examiner

VEHICULAR HEADLAMP

TECHNICAL FIELD

The present invention relates to a vehicular headlamp.

BACKGROUND ART

In the related art, light distribution variable type headlamps have been developed such as so-called "adaptive driving beams (ADBs)," "adaptive hi-beam systems (AHSs)," and "adaptive front-lighting systems (AFSs)." ADBs or AHSs are to suppress light emitted a passenger of a preceding vehicle, a passenger of an oncoming vehicle, or a pedestrian and to prevent those from being dazzled. AFSs are to emit light in the traveling direction of the host vehicle depending on the steering angle of the host vehicle.

For example, a vehicular headlamp of Patent Literature 1 has a plurality of light source modules (ADB lamp units 41R, 42R, and 43R). The light source modules are arrayed along the left-right direction of a vehicle (vehicle C) and corresponds, in a one-to-one manner, to a plurality of partial light distributing patterns (ADB light distributing patterns RSP1, RSP2, and RSP3) obtained by dividing a light distributing pattern for an ADB. The vehicular headlamp of Patent Literature 1 implements the ADB by separately turning on or off the light source modules.

CITATION LIST

Patent Literature

Patent Literature 1: JP 2015-112969 A

SUMMARY OF INVENTION

Technical Problem

In the vehicular headlamp of Patent Literature 1, by arranging the optical axes (optical axes Z3R, Z4R, and Z5R) of the light source modules nonparallel to each other, each of the light source modules is allowed to correspond to the partial light distributing patterns (see FIG. 2 of Patent Literature 1). Therefore, there is a disadvantage that an interval between adjacent light source modules increases, which increases the size of the headlamp in the array direction of the light source modules, that is, in the left-right direction of the vehicle.

The present invention has been devised to solve the disadvantage as the above, and it is an object of the present invention to downsize a vehicular headlamp that forms a light distributing pattern for a light distribution variable type headlamp by using a plurality of light source modules.

Solution to Problem

A vehicular headlamp according to the present invention is capable of freely forming a light distributing pattern for a light distribution variable type headlamp by using a combination of partial light distributing patterns, the vehicular headlamp including: first light source modules corresponding to the partial light distributing patterns and having light projection directions parallel to each other; and a light guide member having first incident surfaces, arranged so as to face the first light source modules and corresponding to the first light source modules, and an emitting surface, arranged so as to face the first incident surfaces and shared by the first light source modules, the light guide member forming the light distributing pattern by deflecting light projected by the first light source modules.

Advantageous Effects of Invention

The present invention enables downsizing of a vehicular headlamp that forms a light distributing pattern for a light distribution variable type headlamp by using a plurality of light source modules.

DESCRIPTION OF EMBODIMENTS

To describe the present invention further in detail, embodiments for carrying out the present invention will be described below along with the accompanying drawings.

First Embodiment

Figure 1:
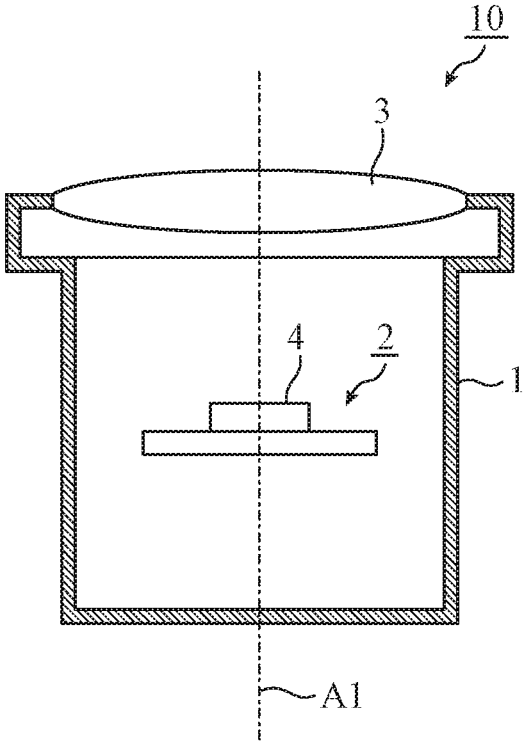
FIG. 1 is an explanatory view illustrating the main part of a light source module according to a first embodiment of the present invention.
Figure 2:
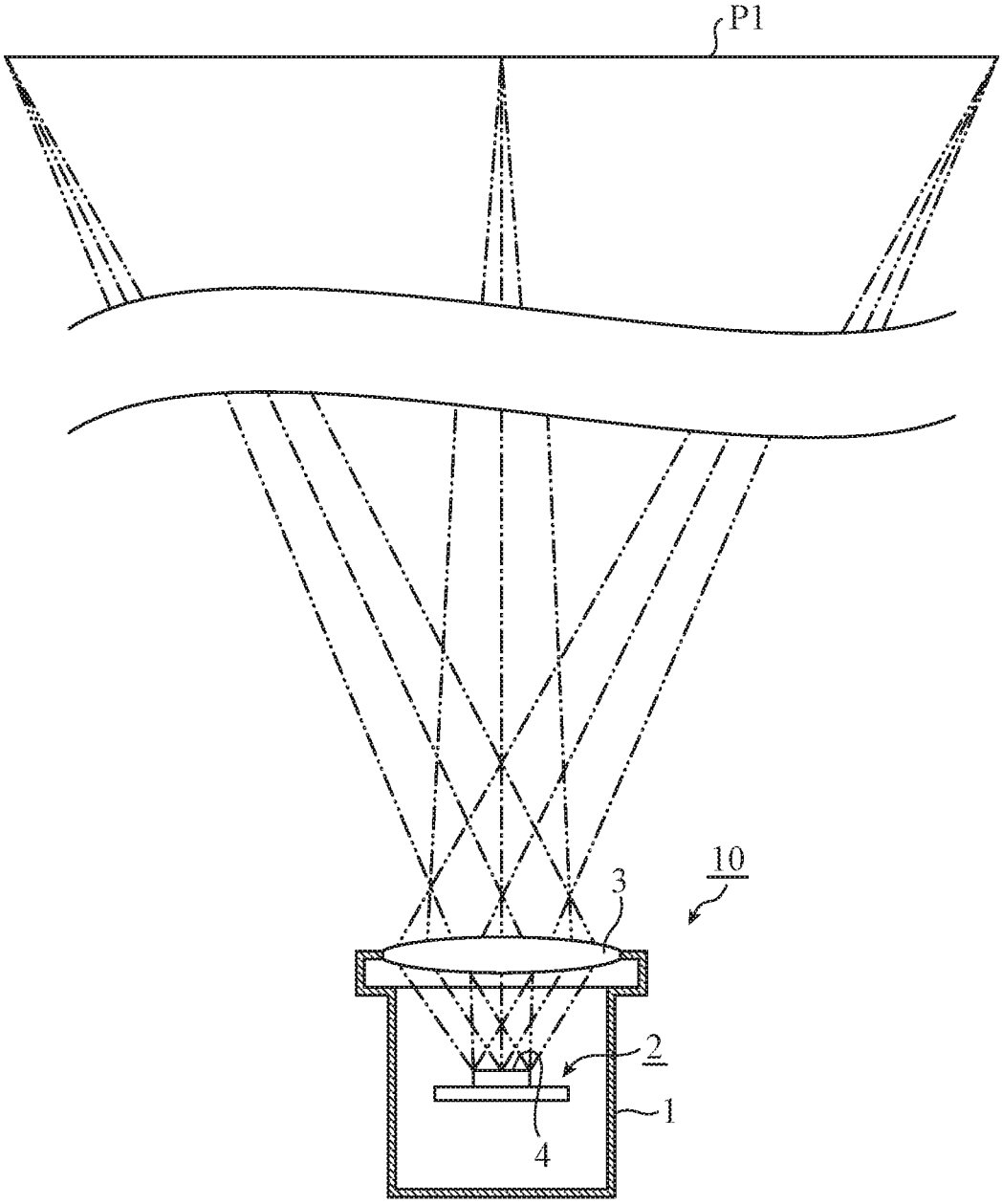
FIG. 2 is an explanatory view illustrating optical paths in the light source module illustrated in FIG. 1.
Figure 3A:
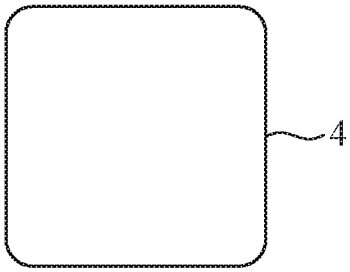
FIG. 3A is an explanatory view illustrating the shape of a light emitting surface of a light source included in the light source module illustrated in FIG. 1.
Figure 3B:
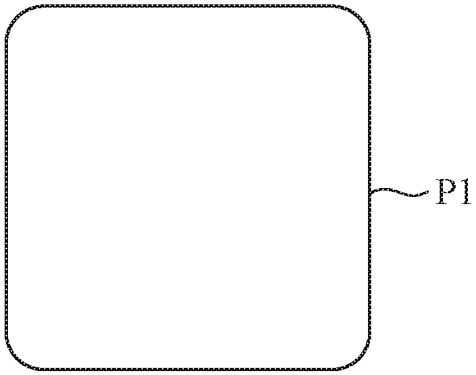
FIG. 3B is an explanatory view illustrating the shape of a light distributing pattern formed by the light source module illustrated in FIG. 1.

FIG. 1 is an explanatory view illustrating the main part of a light source module according to a first embodiment of the present invention. FIG. 2 is an explanatory view illustrating optical paths in the light source module illustrated in FIG. 1. FIG. 3A is an explanatory view illustrating the shape of a light emitting surface of a light source included in the light source module illustrated in FIG. 1. FIG. 3B is an explanatory view illustrating the shape of a light distributing pattern formed by the light source module illustrated in FIG. 1. With reference to FIGS. 1 to 3, a light source module 10 according to the first embodiment will be described.

As illustrated in FIG. 1, a light source 2 is accommodated in a housing 1 having a bottomed substantially cylindrical shape, and a first optical system 3 is provided at an opening of the housing 1. The light source 2 has an emitting surface 4, and the light emitting surface 4 faces the first optical system 3. The housing 1 serves as a heat sink for heat generation of the light source 2. The housing 1, the light source 2, and the first optical system 3 form the main part of the light source module 10.

For example, a light emitting diode (LED) or a semiconductor laser is used in the light source 2. More specifically, for example, the light source 2 may include a combination of a blue LED and a yellow phosphor, a combination of an ultraviolet LED and Red, Green, and Blue (RGB) phosphors, a combination of a blue laser and a yellow phosphor, or RGB lasers. The light source 2 emits white light from the light emitting surface 4.

The first optical system 3 includes, for example, one or more convex lenses, one or more concave mirrors, or a combination thereof. In the example illustrated in FIG. 1, the first optical system 3 is a convex lens. A value of the refractive power (so-called "power," which is represented by a reciprocal of the focal length) by the whole first optical system 3 is set to a positive value. The first optical system 3 projects light emitted from the light emitting surface 4 in a predetermined direction by optical action such as refraction or reflection.

Here, a line A1 illustrated in FIG. 1 represents the optical axis of the first optical system 3, that is, the optical axis of the light source module 10. The direction in which the first optical system 3 projects light, that is, the direction in which the light source module 10 projects light (hereinafter referred to as "light projection direction") is along the optical axis A1. The light projected by the light source module 10 has a predetermined angular intensity distribution with respect to the light projection direction.

A two-dot chain line in FIG. 2 represents an optical path corresponding to a part of light emitted from the light emitting surface 4 as well as an optical path corresponding to a part of light projected by the first optical system 3. As illustrated in FIG. 2, the light projected by the first optical system 3 forms an image at a position far from the light source module 10. As a result, a light distributing pattern P1 is formed.

The shape of the light distributing pattern P1 is a shape corresponding to the shape of the light emitting surface 4. More specifically, the shape of the light distributing pattern P1 has a similar figure to the shape obtained by inverting the shape of the light emitting surface 4 with respect to the optical axis A1. For example, in the case where the shape of the light emitting surface 4 is a substantially square shape as illustrated in FIG. 3A, the shape of the light distributing pattern P1 is a substantially square shape, as illustrated in FIG. 3B, which is larger than the substantially square shape illustrated in FIG. 3A.

Figure 4:
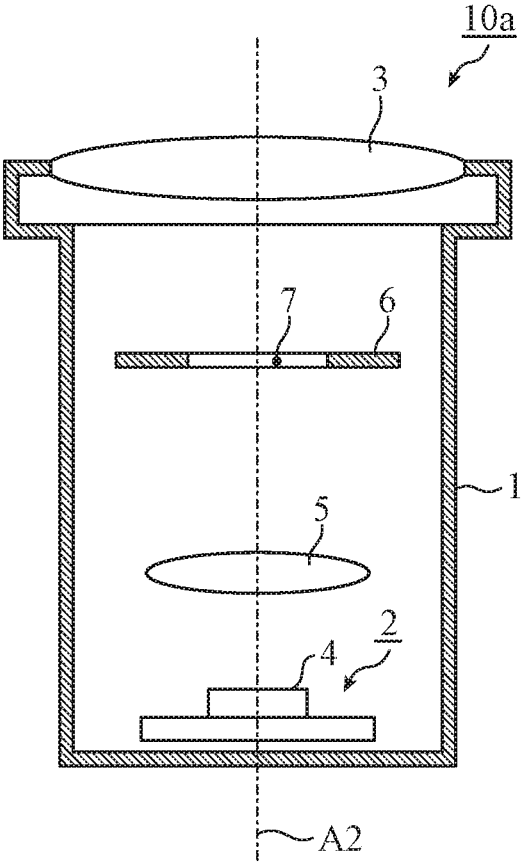
FIG. 4 is an explanatory view illustrating the main part of another light source module according to the first embodiment of the present invention.
Figure 5:
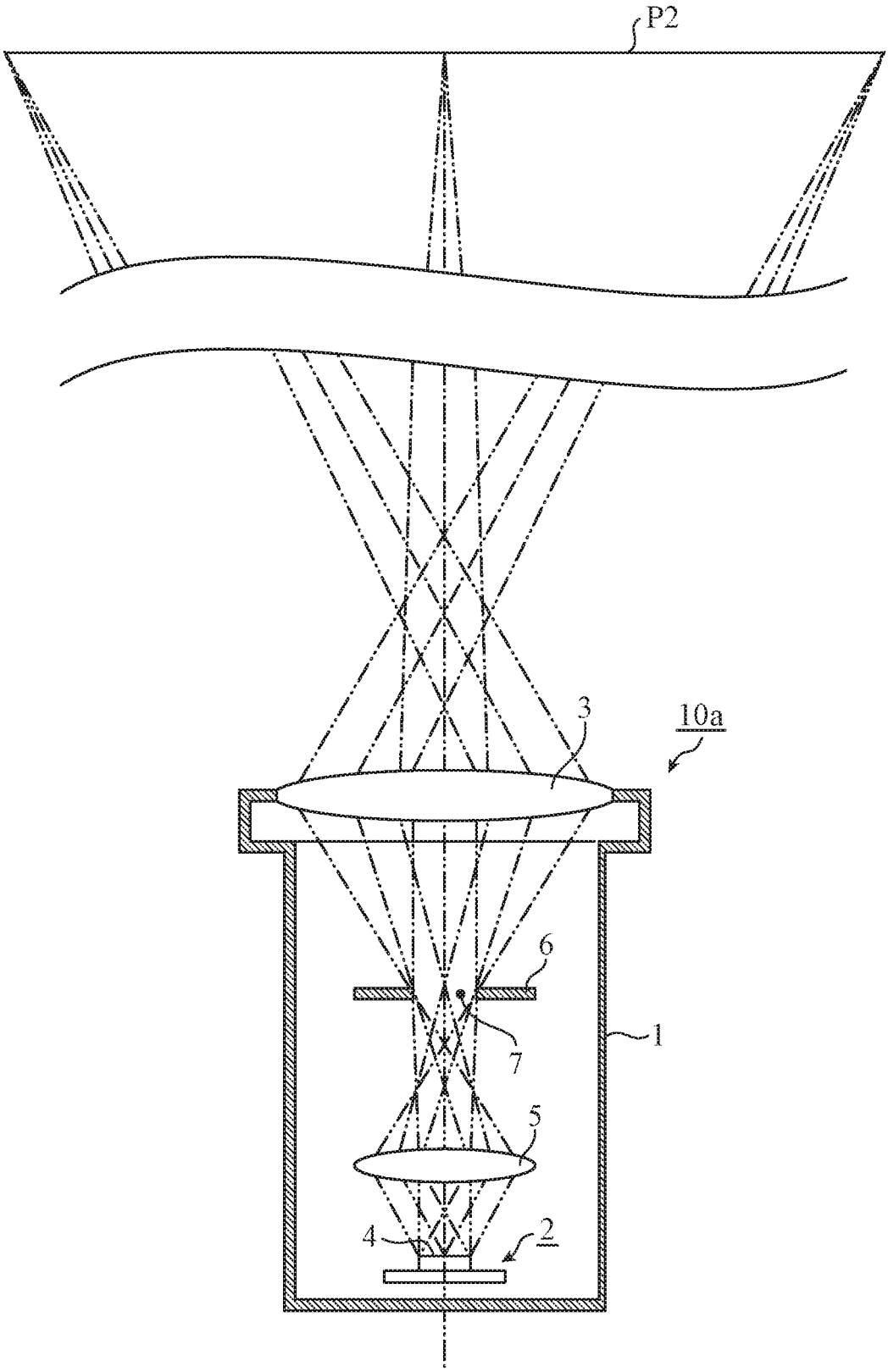
FIG. 5 is an explanatory view illustrating optical paths in the light source module illustrated in FIG. 4.
Figure 6A:
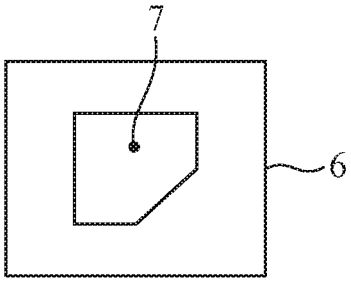
FIG. 6A is an explanatory view illustrating the shape of a through hole of a diaphragm included in the light source module illustrated in FIG. 4.
Figure 6B:
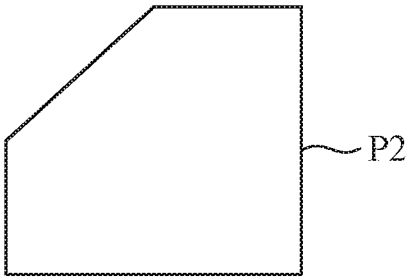
FIG. 6B is an explanatory view illustrating the shape of a light distributing pattern formed by the light source module illustrated in FIG. 4.

FIG. 4 is an explanatory view illustrating the main part of another light source module according to the first embodiment of the present invention. FIG. 5 is an explanatory view illustrating optical paths in the light source module illustrated in FIG. 4. FIG. 6A is an explanatory view illustrating the shape of a through hole of a diaphragm included in the light source module illustrated in FIG. 4. FIG. 6B is an explanatory view illustrating the shape of a light distributing pattern formed by the light source module illustrated in FIG. 4. With reference to FIG. 4 to FIG. 6, another light source module 10*a* according to the first embodiment will be described. Note that a component similar to that of the light source module 10 illustrated in FIGS. 1 to 3 is denoted by the same symbol, and description thereof is omitted.

As illustrated in FIG. 4, a second optical system 5 is provided between a light source 2 and the first optical system 3, and a diaphragm 6 is provided between the first optical system 3 and the second optical system 5. The diaphragm 6 has a substantially frame shape and has a through hole 7. A housing 1, the light source 2, the first optical system 3, the second optical system 5, and the diaphragm 6 form the main part of the light source module 10*a*.

The second optical system 5 includes, for example, one or more convex lenses, one or more concave mirrors, or a combination thereof. In the example illustrated in FIG. 4, the second optical system 5 is a convex lens. The value of the refractive power by the whole second optical system 5 is set to a positive value. The second optical system 5 projects light emitted from a light emitting surface 4 toward the diaphragm 6 by optical action such as refraction or reflection. The first optical system 3 is adapted to project light passed through the diaphragm 6 in a predetermined direction.

Here, a line A2 illustrated in FIG. 4 represents the optical axes of the first optical system 3 and the second optical system 5, that is, the optical axis of the light source module 10*a*. The direction in which the first optical system 3 projects light, that is, the light projection direction of the light source module 10*a* is along the optical axis A2. The light projected by the light source module 10*a* has a predetermined angular intensity distribution with respect to the light projection direction.

A two-dot chain line in FIG. 5 represents an optical path corresponding to a part of light emitted from the light emitting surface 4, an optical path corresponding to a part of light projected by the second optical system 5, and an optical path corresponding to a part of light projected by the first optical system 3. As illustrated in FIG. 5, the light projected by the second optical system 5 forms an image at a position in the vicinity of the diaphragm 6. Furthermore, the light projected by the first optical system 3 forms an image again at a position far from the light source module 10*a*. As a result, a light distributing pattern P2 is formed.

The shape of the light distributing pattern P2 has a shape corresponding to the shape of the through hole 7. More specifically, the shape of the light distributing pattern P2 has a similar figure to the shape obtained by inverting the shape of the through hole 7 with respect to the optical axis A2. For example, in the case where the shape of the through hole 7 is a shape obtained by cutting out the lower right corner of a square as illustrated in FIG. 6A, the shape of the light distributing pattern P2 is, as illustrated in FIG. 6B, a square shape larger than the square illustrated in FIG. 6A with the upper left corner cut out.

Figure 7:
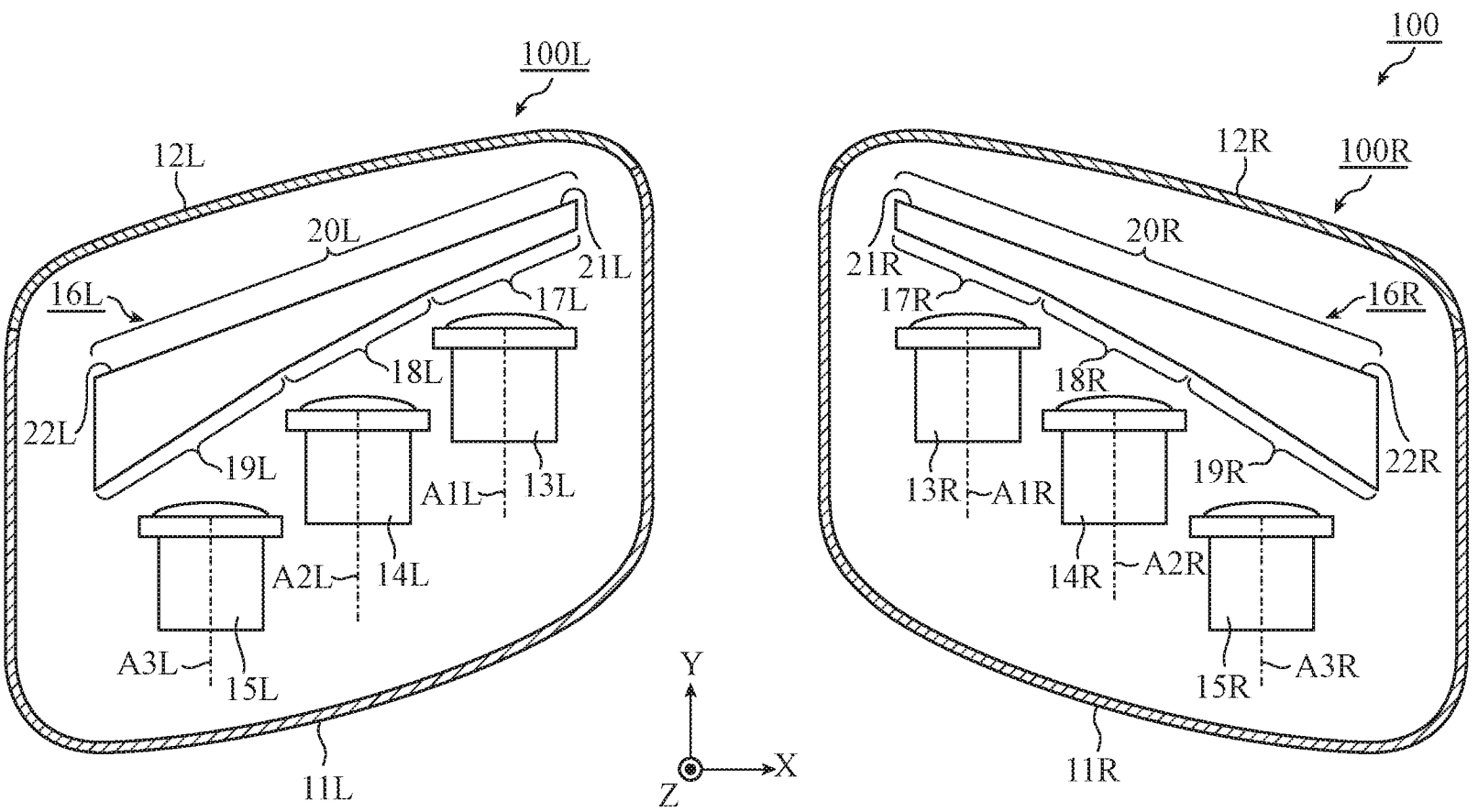
FIG. 7 is an explanatory view illustrating the main part of a headlamp according to the first embodiment of the present invention.
Figure 8A:
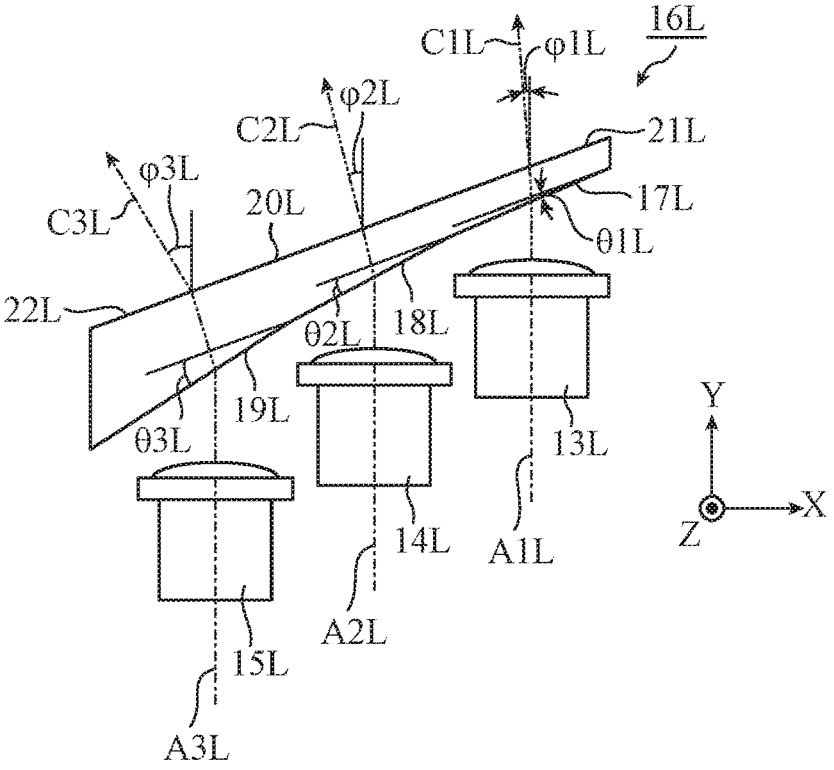
FIG. 8A is an explanatory view illustrating the main optical paths in a left headlamp illustrated in FIG. 7.
Figure 8B:
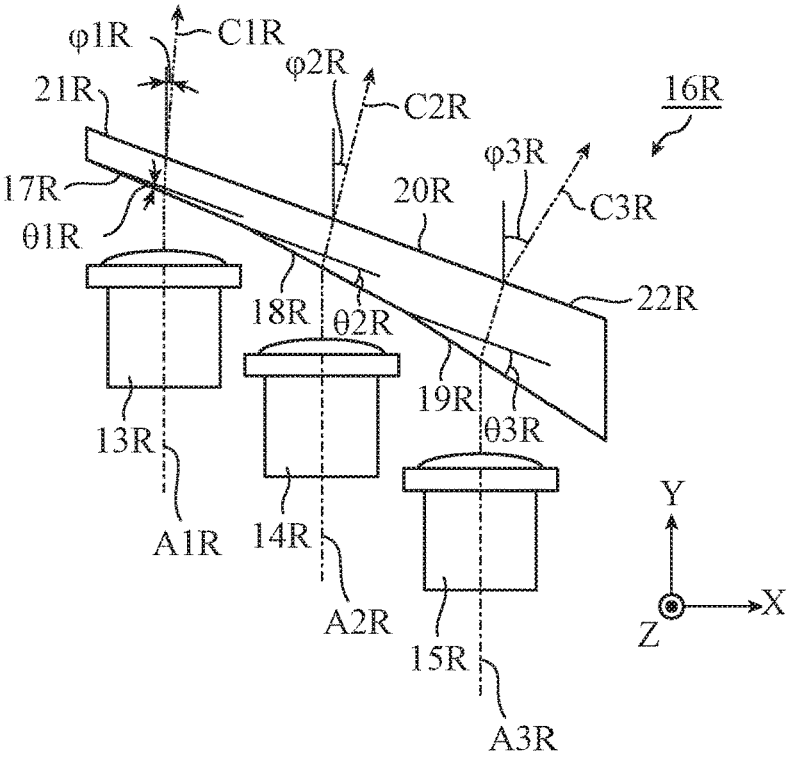
FIG. 8B is an explanatory view illustrating the main optical paths in a right headlamp illustrated in FIG. 7.

FIG. 7 is an explanatory view illustrating the main part of a headlamp according to the first embodiment of the present invention. FIG. 8A is an explanatory view illustrating the main optical paths in a left headlamp illustrated in FIG. 7. FIG. 8B is an explanatory view illustrating the main optical paths in a right headlamp illustrated in FIG. 7. With reference to FIGS. 7 and 8, a headlamp 100 of the first embodiment will be described.

As illustrated in FIG. 7, the headlamp 100 includes a left headlamp 100L and a right headlamp 100R. The left headlamp 100L is mounted on the left end in the front end of a vehicle which is not illustrated (hereinafter simply referred to as "vehicle"), and the right headlamp 100R is mounted on the right end in the front end of the vehicle. In the drawing, the X-axis extends along the left-right direction with respect to the vehicle, the Y-axis extends along the front-rear direction with respect to the vehicle, and the Z-axis extends along the vertical direction with respect to the vehicle.

First, the left headlamp 100L will be described. In the drawing, a symbol 11L denotes a main body case. The main body case 11L has a front opening, and the front opening is closed by a cover lens 12L.

Three first light source modules 13L, 14L, and 15L are accommodated in the main body case 11L. Each of the first light source modules 13L, 14L, and 15L has a similar structure to that of the light source module 10 illustrated in FIGS. 1 and 2, or has a similar structure to that of the light source module 10*a* illustrated in FIGS. 4 and 5. In the example illustrated in FIG. 7, the first light source modules 13L, 14L, and 15L are arrayed along the left-right direction with respect to the vehicle. In other words, the first light source module 13L, the first light source module 14L, and the first light source module 15L are sequentially arranged from the inner side toward the outer side of the vehicle.

Optical axes A1L, A2L, and A3L of the first light source modules 13L, 14L, and 15L are provided substantially parallel to each other. As a result, the first light source modules 13L, 14L, and 15L have light projection directions substantially parallel to each other. In the example illustrated in FIG. 7, the optical axes A1L, A2L, and A3L of the first light source modules 13L, 14L, and 15L are provided in directions along the front-rear direction with respect to the vehicle. Thus, each of the first light source modules 13L, 14L, and 15L projects light forward from the vehicle.

The first light source modules 13L, 14L, and 15L are used to form a light distributing pattern (hereinafter referred to as "first light distributing pattern") PL for a light distribution variable type headlamp. The first light distributing pattern PL is, for example, a light distributing pattern for ADB, and is formed by a combination of three partial light distributing patterns P1L, P2L, and P3L. The first light source modules 13L, 14L, and 15L correspond to the partial light distributing patterns P1L, P2L, and P3L, respectively. Specific examples of the first light distributing pattern PL and the partial light distributing patterns P1L, P2L, and P3L will be described later with reference to FIGS. 9 to 11.

A light guide member 16L is provided between the first light source modules 13L, 14L, and 15L and the cover lens 12L. The light guide member 16L is made of a transparent material such as plastic such as acryl or polycarbonate or glass. The light guide member 16L can be manufactured by molding such plastic or cutting and polishing such glass.

The light guide member 16L has three first incident surfaces 17L, 18L, and 19L. The first incident surfaces 17L, 18L, and 19L correspond to the first light source modules 13L, 14L, and 15L, respectively. The first incident surfaces 17L, 18L, and 19L are arranged to face the first light source modules 13L, 14L, and 15L, respectively. In the example illustrated in FIG. 7, each of the first incident surfaces 17L, 18L, and 19L is planar.

The light guide member 16L has one emitting surface 20L. The emitting surface 20L is shared by all of the first light source modules 13L, 14L, and 15L, and is arranged so as to face all of the first incident surfaces 17L, 18L, and 19L. The emitting surface 20L has a shape having a longitudinal direction along the array direction of the first incident surfaces 17L, 18L, and 19L, that is, the array direction of the first light source modules 13L, 14L, and 15L. In the example illustrated in FIG. 7, one end 21L of the emitting surface 20L is arranged on the inner side of the vehicle, and another end 22L of the emitting surface 20L is arranged on the outer side of the vehicle. Furthermore, in the example illustrated in FIG. 7, the emitting surface 20L is planar.

The main body case 11L, the cover lens 12L, the first light source modules 13L, 14L, and 15L, and the light guide member 16L form the main part of the left headlamp 100L.

In this example as illustrated in FIG. 8A, angles (hereinafter referred to as "tilt angles") θ1L, θ2L, and θ3L of the first incident surfaces 17L, 18L, and 19L with respect to the emitting surface 20L are set at different values from each other, respectively. In the example illustrated in FIG. 8A, the tilt angles θ1L, θ2L, and θ3L are set at values that gradually increase from the one end 21L toward the other end 22L of the emitting surface 20L, that is, from the inner side toward the outer side of the vehicle.

Light projected by the first light source modules 13L, 14L, and 15L is incident on the first incident surfaces 17L, 18L, and 19L, respectively. At this time, rays of light are deflected by the first incident surfaces 17L, 18L, and 19L. The rays of light having passed through the light guide member 16L are emitted from the emitting surface 20L. At this time, the rays of light are again deflected by the emitting surface 20L.

A symbol C1L indicated by a two-dot chain line arrow in FIG. 8A represents an optical path corresponding to the portion having the highest intensity (hereinafter referred to as "main optical path") in the light projected by the first light source module 13L. Likewise, a symbol C2L represents the main optical path corresponding to the light projected by the first light source module 14L, and a symbol C3L represents the main optical path corresponding to the light projected by the first light source module 15L. Hereinafter, a direction along the portion corresponding to light emitted from the emitting surface 20L in the main optical paths C1L, C2L, and C3L is referred to as "emission direction."

Since the tilt angles θ1L, θ2L, and θ3L are set to values different from each other, the angles of emission directions φ1L, φ2L, and φ3L with respect to the light projection directions (hereinafter referred to as "emission angles") are different for each of the first light source modules 13L, 14L, and 15L. Note that, in the example illustrated in FIG. 8A, the emission angles φ1L, φ2L, and φ3L are set at values that gradually increase from the one end 21L toward the other end 22L of the emitting surface 20L, that is, from the inner side toward the outer side of the vehicle.

Note that in the example illustrated in FIG. 8A, portions of the light guide member 16L corresponding to the respective first incident surfaces 17L, 18L, and 19L are formed such that the thickness on the other end 22L side has a larger value than the thickness on the one end 21L side. Therefore, each of the tilt angles θ1L, θ2L, and θ3L is set to an angle in the counterclockwise direction with respect to the Z axis in the drawing. In addition, each of the emission angles φ1L, φ2L, and φ3L is an angle in the counterclockwise direction with respect to the Z axis in the drawing.

The amount of deflection in the first incident surfaces 17L, 18L, and 19L is determined by the so-called "Snell's law" on the basis of the value of refractive index of the light guide member 16L relative to the refractive index of the air (which is generally approximately 1) and the incident angle of light to the first incident surfaces 17L, 18L, and 19L. Similarly, the amount of deflection in the emitting surface 20L is determined by the Snell's law on the basis of the value of the refractive index of the air relative to the refractive index of the light guide member 16L and the incident angle of light to the emitting surface 20L. Values of the incident angle of light on the first incident surfaces 17L, 18L, and 19L and the emitting surface 20L are dependent on the tilt angles θ1L, θ2L, and θ3L. Therefore, by setting the tilt angles θ1L, θ2L, and θ3L to appropriate values, desired emission angles φ1L, φ2L, and φ3L can be obtained.

Next, the right headlamp 100R will be described. As illustrated in FIG. 7, the right headlamp 100R has a structure obtained by horizontally inverting the left headlamp 100L. That is, a main body case 11R has a front opening, and the front opening is closed by a cover lens 12R.

Three first light source modules 13R, 14R, and 15R are accommodated in the main body case 11R. Each of the first light source modules 13R, 14R, and 15R has a similar structure to that of the light source module 10 illustrated in FIGS. 1 and 2, or has a similar structure to that of the light source module 10*a* illustrated in FIGS. 4 and 5. The first light source modules 13R, 14R, and 15R are arrayed along the left-right direction with respect to the vehicle. Optical axes A1R, A2R, and A3R of the first light source modules 13R, 14R, and 15R are provided substantially parallel to each other.

The first light source modules 13R, 14R, and 15R are used to form a light distributing pattern (hereinafter referred to as "first light distributing pattern") PR for a light distribution variable type headlamp. The first light distributing pattern PR is, for example, a light distributing pattern for ADB, and is formed by a combination of three partial light distributing patterns P1R, P2R, and P3R. The first light source modules 13R, 14R, and 15R correspond to the partial light distributing patterns P1R, P2R, and P3R, respectively. Specific examples of the first light distributing pattern PR and the partial light distributing patterns P1R, P2R, and P3R will be described later with reference to FIGS. 9 to 11.

A light guide member 16R is provided between the first light source modules 13R, 14R, and 15R and the cover lens 12R. The light guide member 16R has three first incident surfaces 17R, 18R, and 19R corresponding to the first light source modules 13R, 14R, and 15R, respectively, as well as one emitting surface 20R shared by the first light source modules 13R, 14R, and 15R. One end 21R of the emitting surface 20R is arranged on the inner side of the vehicle, and another end 22R of the emitting surface 20R is arranged on the outer side of the vehicle.

The main body case 11R, the cover lens 12R, the first light source modules 13R, 14R, and 15R, and the light guide member 16R form the main part of the right headlamp 100R.

As illustrated in FIG. 8B, in the light guide member 16R, tilt angles θ1R, θ2R, and θ3R are set to values different from each other. Symbols C1R, C2R, and C3R in FIG. 8B represent the main optical paths corresponding to light projected by the first light source modules 13R, 14R, and 15R, respectively. Emission angles φ1R, φ2R, and φ3R have values different for each of the first light source modules 13R, 14R, and 15R. By setting the tilt angles θ1R, θ2R, and θ3R to appropriate values, desired emission angles φ1R, φ2R, and φ3R can be obtained.

Next, specific examples of the first light distributing patterns PL and PR and the partial light distributing patterns P1L, P2L, P3L, P1R, P2R, and P3R will be described with reference to FIGS. 9 to 11.

Figure 9:
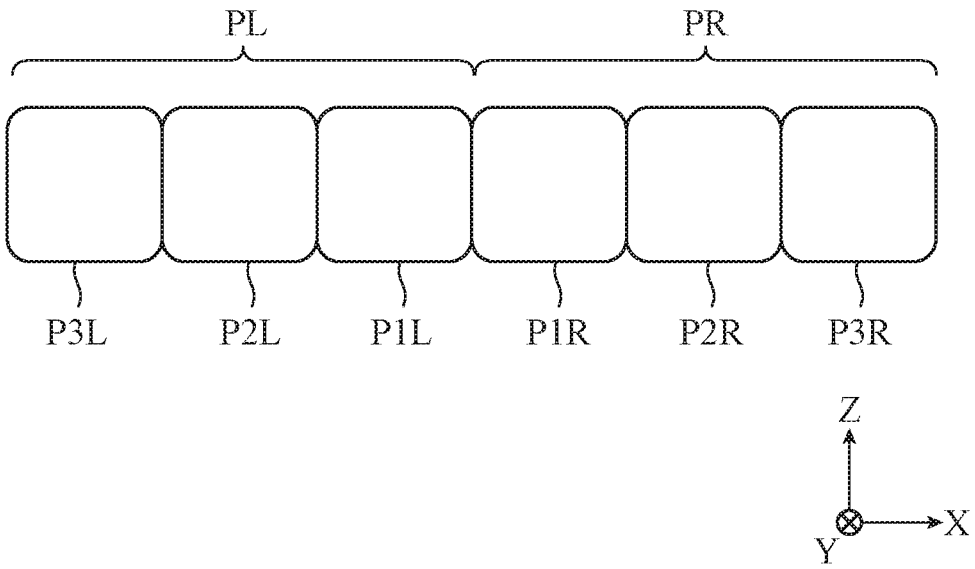
FIG. 9 is an explanatory view illustrating a light distributing pattern formed by the headlamp illustrated in FIG. 7.

FIG. 9 illustrates an example of the first light distributing patterns PL and PR. As illustrated in FIG. 9, the first light distributing pattern PL on the left half with respect to the vehicle is formed by a combination of three partial light distributing patterns P1L, P2L, and P3L, and the first light distributing pattern PR on the right half with respect to the vehicle is formed by a combination of three partial light distributing patterns P1R, P2R, and P3R. In the example illustrated in FIG. 9, the shape of each of the partial light distributing patterns P1L, P2L, P3L, P1R, P2R, and P3R is substantially square.

The partial light distributing patterns P1L, P2L, P3L, P1R, P2R, and P3R are arrayed along the left-right direction with respect to the vehicle. The partial light distributing patterns P1L, P2L, P3L, P1R, P2R, and P3R correspond to the first light source modules 13L, 14L, 15L, 13R, 14R, and 15R, respectively. By separately turning on or off the first light source modules 13L, 14L, 15L, 13R, 14R, and 15R depending on whether there is a preceding vehicle, an oncoming vehicle, or a pedestrian, the ADB can be implemented.

Note that the partial light distributing patterns P1L, P2L, and P3L forming the first light distributing pattern PL of the left half correspond to the first light source modules 13L, 14L, and 15L provided in the left headlamp 100L, respectively. The arrangement order of the partial light distributing patterns P1L, P2L, and P3L in the first light distributing pattern PL coincides with the arrangement order of the first light source modules 13L, 14L, and 15L in the left headlamp 100L. Moreover, the partial light distributing patterns P1R, P2R, and P3R forming the first light distributing pattern PR in the right half correspond to the first light source modules 13R, 14R, and 15R provided in the right headlamp 100R, respectively. The arrangement order of the partial light distributing patterns P1R, P2R, and P3R in the first light distributing pattern PR coincides with the arrangement order of the first light source modules 13R, 14R, and 15R in the right headlamp 100R.

In the first light distributing patterns PL and PR illustrated in FIG. 9, adjacent partial light distributing patterns among the six partial light distributing patterns P1L, P2L, P3L, P1R, P2R, and P3R are arranged so as not to be superimposed with each other. Contrarily, as illustrated in FIG. 10, edges of the adjacent partial light distributing patterns among the six partial light distributing patterns P1L, P2L, P3L, P1R, P2R, and P3R may be arranged so as to be superimposed with each other. Depending on the optical characteristics of the individual first light source modules 13L, 14L, 15L, 13R, 14R, and 15R, in the case where edges of corresponding partial light distributing patterns are darker than the central parts of the partial distribution light patterns, superimposing the edges can reduce unevenness in brightness in the entire first light distributing patterns PL and PR.

Figure 11:
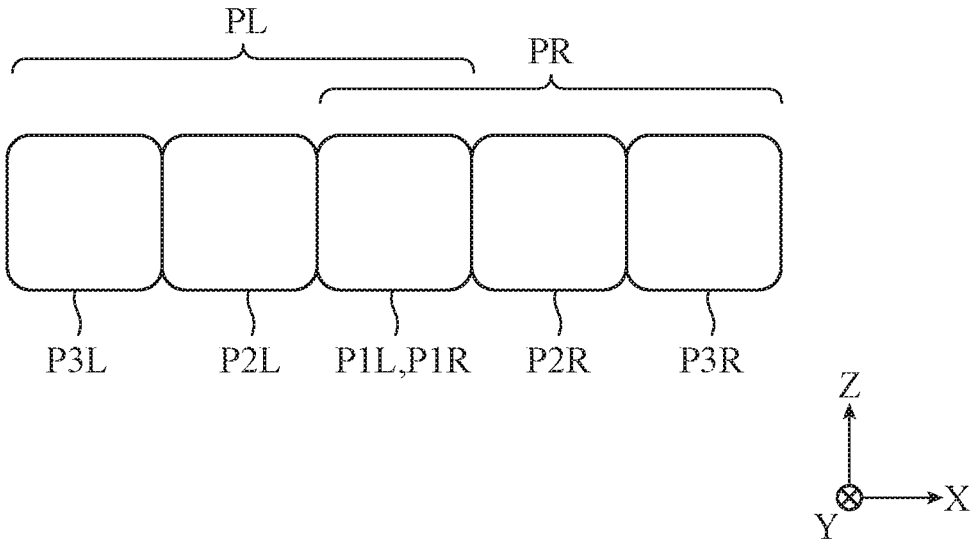
FIG. 11 is an explanatory view illustrating another light distributing pattern formed by the headlamp illustrated in FIG. 7.

Alternatively, as illustrated in FIG. 11, substantially all of the partial light distributing pattern P1L arranged innermost with respect to the vehicle in the first light distributing pattern PL and substantially all of the partial light distributing pattern P1R arranged innermost with respect to the vehicle in the first light distributing pattern PR may be arranged so as to be superimposed with each other. With this arrangement, the area in front of the vehicle becomes brighter, which enables implementation of a headlamp 100 capable of emitting light farther.

Next, the effect of the headlamp 100 will be described. With provision of the light guide member 16L for deflection, the left headlamp 100L allows the first light source modules 13L, 14L, and 15L to correspond to the partial light distributing patterns P1L, P2L, and P3L, respectively, while the optical axes A1L, A2L, and A3L are arranged substantially parallel to each other. As a result, as compared with the vehicular headlamp in which the optical axes are arranged nonparallel to each other as illustrated in Patent Literature 1, the array direction of the first light source modules 13L, 14L, and 15L, that is, the size of the left headlamp 100L in the left-right direction with respect to the vehicle can be reduced.

Similarly, with provision of the light guide member 16R for deflection, the right headlamp 100R allows the first light source modules 13R, 14R, and 15R to correspond to the partial light distributing patterns P1R, P2R, and P3R, respectively, while the optical axes A1R, A2R, and A3R are arranged substantially parallel to each other. As a result, the array direction of the first light source modules 13R, 14R, and 15R, that is, the size of the right headlamp 100R in the left-right direction of the vehicle can be reduced.

Furthermore, in the headlamp 100, the first light source modules 13L, 14L, and 15L correspond to the partial light distributing patterns P1L, P2L, and P3L, respectively, and the first light source modules 13R, 14R, and 15R correspond to the partial light distributing patterns P1R, P2R, and P3R, respectively. This facilitates heat dissipation of a light source 2 included in each of the first light source modules 13L, 14L, 15L, 13R, 14R, and 15R.

In the case where one light source module 10 is included in the left headlamp 100L and light sources 2 are included in a housing 1 of the light source module 10 to allow the light sources 2 to correspond to the partial light distributing patterns P1L, P2L, and P3L, it is difficult to radiate the heat due to the dense light sources 2. As a result, there arise disadvantages such as that the light source 2 is damaged by heat or that a sufficiently bright first light distributing pattern PL cannot be obtained. Similar disadvantages also arise in the right headlamp 100R as well. On the other hand, in the headlamp 100 of the first embodiment, the first light source modules 13L, 14L, and 15L correspond to the partial light distributing patterns P1L, P2L, and P3L, respectively, and the first light source modules 13R, 14R, and 15R correspond to the partial light distributing patterns P1R, P2R, and P3R, respectively. This can prevent the light sources 2 to be dense and facilitate heat dissipation of the light sources 2.

Note that, in the example illustrated in FIGS. 7 and 8, the optical axes A1L, A2L, A3L, A1R, A2R, and A3R are provided along the front-rear direction of the vehicle; however, the optical axes A1L, A2L, A3L, A1R, A2R, and A3R may be inclined with respect to the front-rear direction of the vehicle.

In addition, the number of partial light distributing patterns forming the first light distributing pattern PL is not limited to three, and the number of first light source modules included in the left headlamp 100L is limited to three, either. The left headlamp 100L is only required to include first light source modules that correspond to partial light distributing patterns. Similarly, the right headlamp 100R is only required to include first light source modules that correspond to partial light distributing patterns.

In addition, the light projection directions of the first light source modules 13L, 14L, and 15L are only required to be substantially parallel to each other and may not be completely parallel thereto. Similarly, the light projection directions of the first light source modules 13R, 14R, and 15R are only required to be substantially parallel to each other and may not be completely parallel thereto. The meaning of the term "parallel" described herein is not limited to a completely parallel state but also includes a substantially parallel state.

Figure 10:
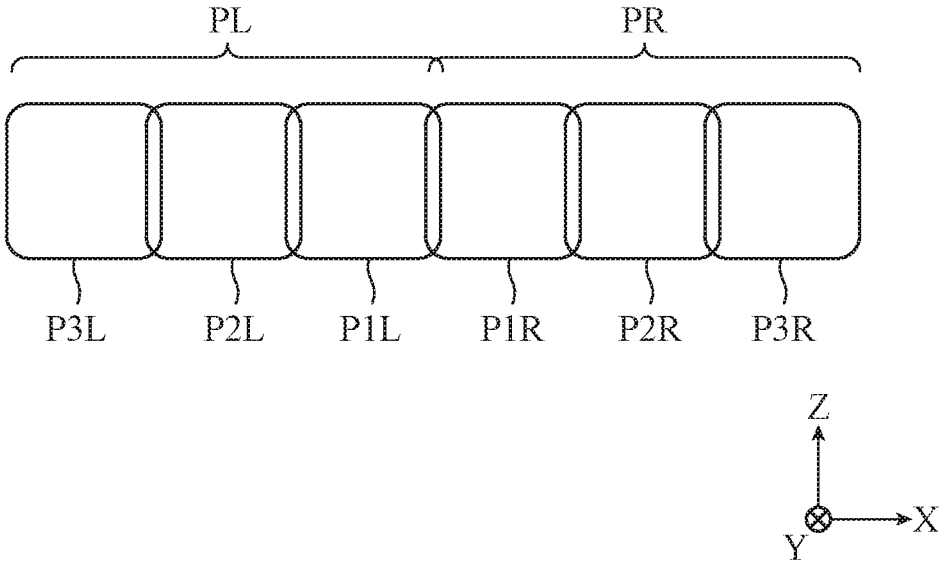
FIG. 10 is an explanatory view illustrating another light distributing pattern formed by the headlamp illustrated in FIG. 7.

Furthermore, the first light distributing patterns PL and PR formed by the headlamp 100 are only required to be a light distributing pattern for a light distribution variable type headlamp and is not limited to the light distributing patterns for ADB illustrated in FIGS. 9 to 11. The first light distributing patterns PL and PR may be, for example, a light distributing pattern for AFS.

In addition, the light guide member 16L is only required to form the first light distributing pattern PL by deflecting light projected by each of the first light source modules 13L, 14L, and 15L, and this principle is not limited to setting the tilt angles θ1L, θ2L, and θ3L at values different from each other. For example, the light guide member 16L may include different materials at a portion where light projected by the first light source module 13L passes (that is, a portion including the first incident surface 17L), a portion where light projected by the first light source module 14L passes (that is, a portion including the first incident surface 18L), and a portion where light projected by the first light source module 15L passes (that is, a portion including the first incident surface 19L) to set refractive indices of these portions at values different from each other. As a result, in the light guide member 16L, the tilt angles θ1L, θ2L, and θ3L may be set at values substantially equivalent to each other with the light guide member 16L deflecting light projected by each of the first light source modules 13L, 14L, and 15L to form the first light distributing pattern PL. This is similarly applied to the light guide member 16R as well.

As described above, the left headlamp 100L according to the first embodiment is capable of freely forming the first light distributing pattern PL for a light distribution variable type headlamp by using a combination of partial light distributing patterns P1L, P2L, and P3L. The left headlamp 100L includes: the first light source modules 13L, 14L, and 15L corresponding to the partial light distributing patterns P1L, P2L, and P3L and having light projection directions parallel to each other; and the light guide member 16L having the first incident surfaces 17L, 18L, and 19L, arranged so as to face the first light source modules 13L, 14L, and 15L and corresponding to the first light source modules 13L, 14L, and 15L, and the emitting surface 20L, arranged so as to face the first incident surfaces 17L, 18L, and 19L and shared by the first light source modules 13L, 14L, and 15L, the light guide member 16L forming the first light distributing pattern PL by deflecting light projected by the first light source modules 13L, 14L, and 15L. This allows the intervals between the first light source modules 13L, 14L, and 15L to be reduced to downsize the left headlamp 100L. Moreover, this facilitates heat dissipation of a light source 2 included in each of the first light source modules 13L, 14L, and 15L. This is similarly applied to the right headlamp 100R as well.

In addition, the first incident surfaces 17L, 18L, and 19L are set to have different tilt angles θ1L, θ2L, and θ3L with respect to the emitting surface 20L. As a result, the light guide member 16L can deflect light projected by the first light source modules 13L, 14L, and 15L to form the first light distributing pattern PL. Furthermore, by setting the tilt angles θ1L, θ2L, and θ3L to appropriate values, desired emission angles φ1L, φ2L, and φ3L can be obtained. This is similarly applied to the right headlamp 100R as well.

The first incident surfaces 17L, 18L, and 19L are arrayed along the longitudinal direction of the emitting surface 20L, and the tilt angles θ1L, θ2L, and θ3L of the first incident surfaces 17L, 18L, and 19L with respect to the emitting surface 20L are set at values which gradually increase from the one end 21L toward the other end 22L of the emitting surface 20L. As a result, the emission angles φ1L, φ2L, and φ3L have values that gradually increase from the one end 21L toward the other end 22L of the emitting surface 20L. As a result, the arrangement order of the first light source modules 13L, 14L, and 15L in the left headlamp 100L can be allowed to coincide with the arrangement order of the partial light distributing patterns P1L, P2L, and P3L in the first light distributing pattern PL. This is similarly applied to the right headlamp 100R as well.

Second Embodiment

Figure 12:
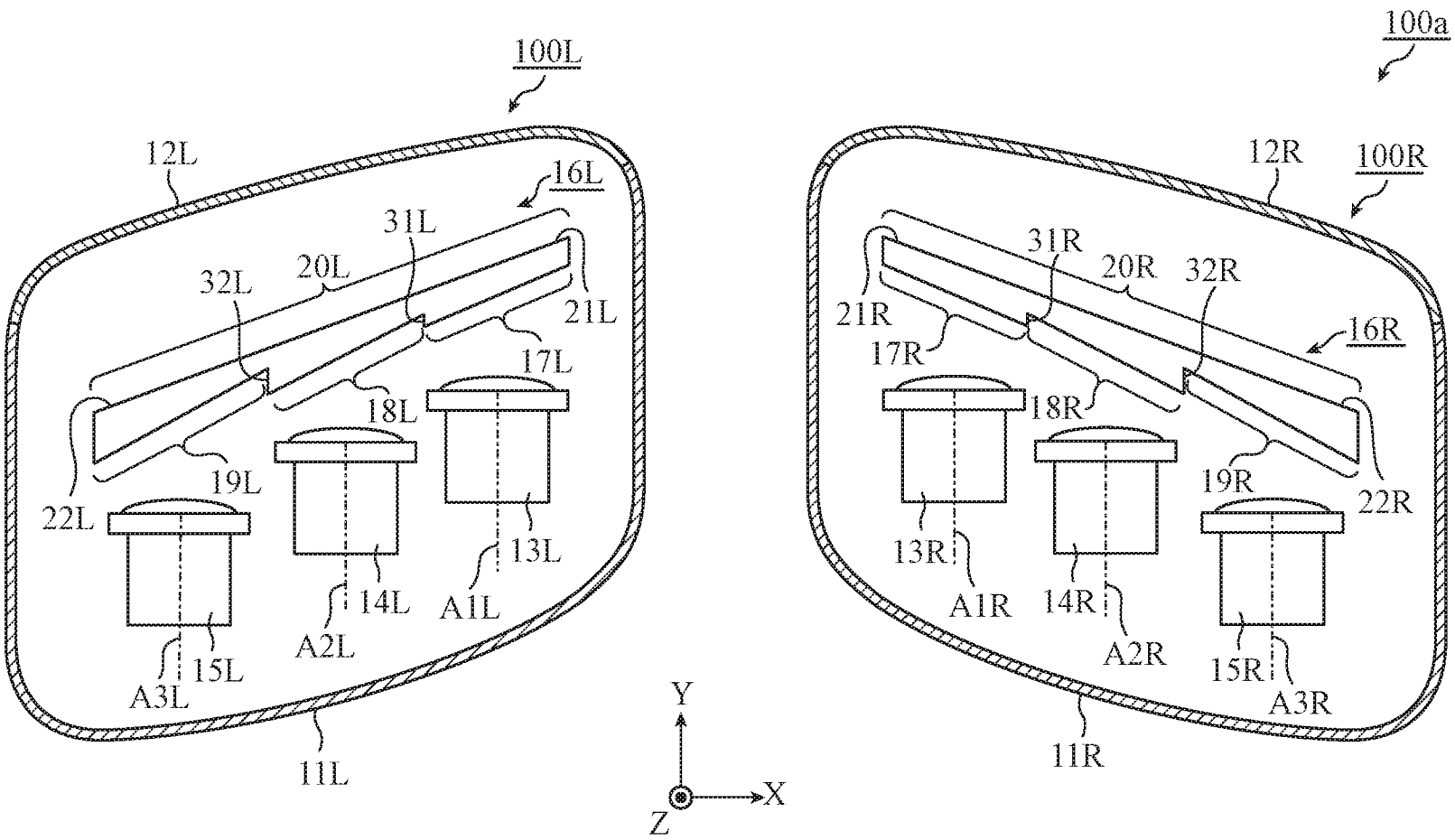
FIG. 12 is an explanatory view illustrating the main part of a headlamp according to a second embodiment of the present invention.
Figure 13A:
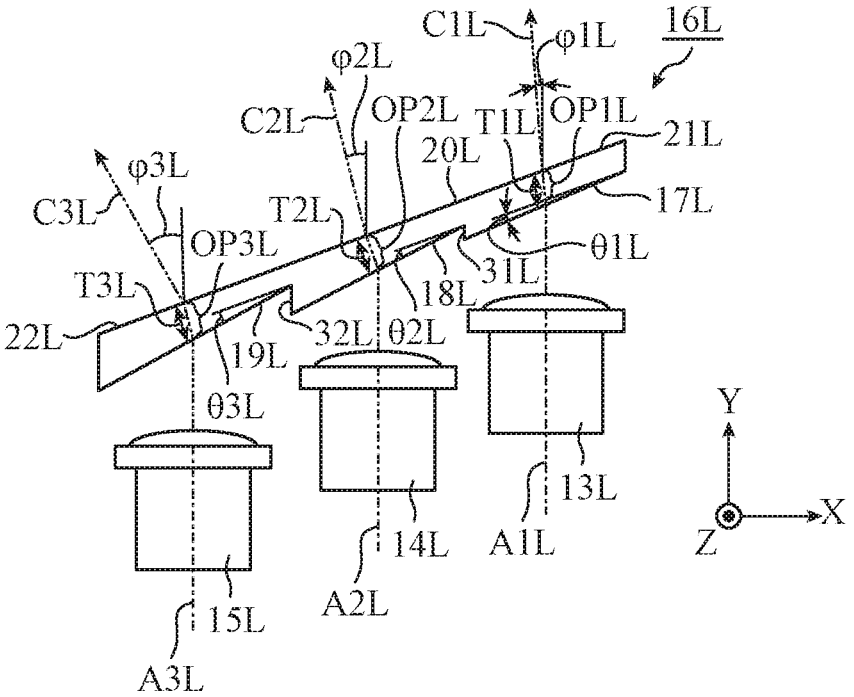
FIG. 13A is an explanatory view illustrating the main optical paths in a left headlamp illustrated in FIG. 12.
Figure 13B:
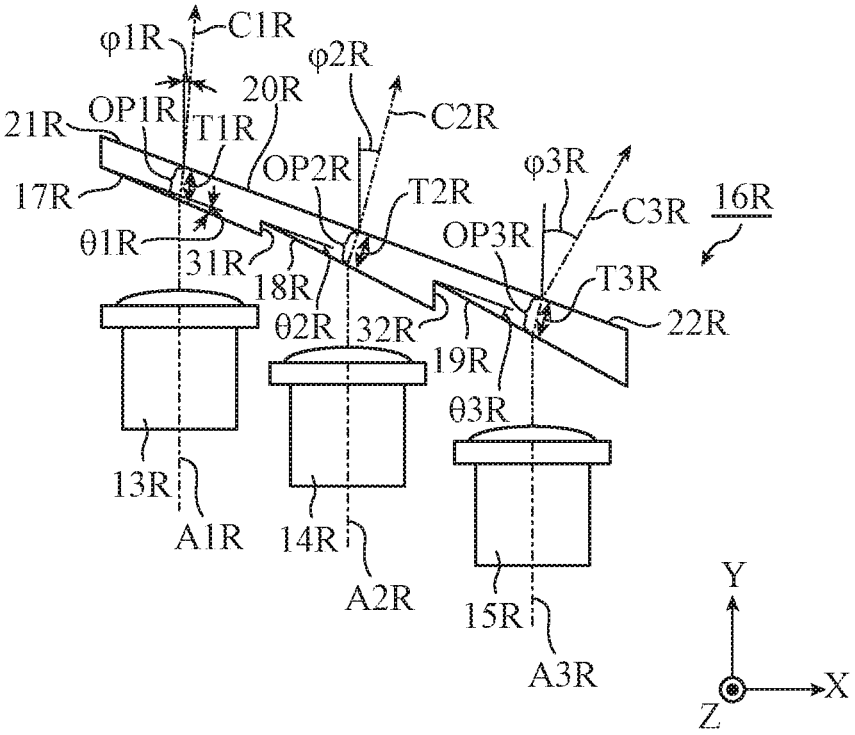
FIG. 13B is an explanatory view illustrating the main optical paths in a right headlamp illustrated in FIG. 12.

FIG. 12 is an explanatory view illustrating the main part of a headlamp according to a second embodiment of the present invention. FIG. 13A is an explanatory view illustrating the main optical paths in a left headlamp illustrated in FIG. 12. FIG. 13B is an explanatory view illustrating the main optical paths in a right headlamp illustrated in FIG. 12. With reference to FIGS. 12 and 13, a headlamp 100*a* of the second embodiment will be described. Note that a component or the like similar to that of the headlamp 100 of the first embodiment illustrated in FIGS. 7 and 8 is denoted by the same symbol, and description thereof will be omitted.

In a light guide member 16L, a step surface 31L is formed between first incident surfaces 17L and 18L adjacent to each other, and a step surface 32L is formed between first incident surfaces 18L and 19L adjacent to each other. With this arrangement, thicknesses T1L, T2L, and T3L of the portions of the light guide member 16L through which the main optical paths C1L, C2L, and C3L pass are set to values substantially equivalent to each other.

In the example illustrated in FIG. 13A, the main optical path C1L passes through the central part of the first incident surface 17L, the main optical path C2L passes through the central part of the first incident surface 18L, and the main optical path C3L passes through the central part of the first incident surface 19L. Therefore, in the light guide member 16L illustrated in FIG. 13A, a thickness T1L of a portion corresponding to the central part of the first incident surface 17L, a thickness T2L of a portion corresponding to the central part of the first incident surface 19L, and a thickness T3L of a portion corresponding to the central part of the first incident surface 18L are set to values substantially equivalent to each other. Here, the "central part" refers to a central part in the left-right direction (direction along the X axis in the drawing) of the vehicle and in the vertical direction of the vehicle (direction along the Z axis in the drawing).

By providing the step surfaces 31L and 32L, the thickness of the light guide member 16L can be reduced. As a result, the weight of the left headlamp 100L can be reduced. Moreover, by setting the thicknesses T1L, T2L, and T3L to values substantially equivalent to each other, optical path lengths OP1L, OP2L, and OP3L in the light guide member 16L in the main optical paths C1L, C2L, and C3L, respectively, can have values substantially equivalent to each other. As a result, differences in the optical characteristics of light corresponding to each of partial light distributing patterns P1L, P2L, and P3L can be reduced to improve the quality of a first light distributing pattern PL. Since specific examples of the first light distributing pattern PL and the partial light distributing patterns P1L, P2L, and P3L are similar to those explained in the first embodiment with reference to FIGS. 9 to 11, illustration and description thereof are omitted.

A light guide member 16R has a similar shape to that of the light guide member 16L. That is, in the light guide member 16R, a step surface 31R is formed between first incident surfaces 17R and 18R, and a step surface 32R is formed between first incident surfaces 18R and 19R. Thicknesses T1R, T2R, and T3R are set to values substantially equivalent to each other by the step surfaces 31R and 32R. With this arrangement, the thickness of the light guide member 16R can be reduced to reduce the weight of the right headlamp 100R. Furthermore, optical path lengths OP1R, OP2R, and OP3R in the light guide member 16R in the main optical paths C1R, C2R, and C3R can be set to values substantially equivalent to each other to improve the quality of the first light distributing pattern PR. Since specific examples of the first light distributing pattern PR and the partial light distributing patterns P1R, P2R, and P3R are similar to those explained in the first embodiment with reference to FIGS. 9 to 11, and thus illustration and description thereof are omitted.

Note that the thicknesses T1L, T2L, and T3L are only required to have values substantially equivalent to each other and may not be exactly the same value. Similarly, the thicknesses T1R, T2R, and T3R are only required to have values substantially equivalent to each other and may not be exactly the same value. The meaning of the term "equivalent" described herein is not limited to a completely equivalent state but also includes a substantially equivalent state.

In addition, the headlamp 100*a* of the second embodiment can adopt various modifications similar to those described in the first embodiment. For example, the number of first light source modules in the left headlamp 100L is not limited to three, and the number of first light source modules in the right headlamp 100R is not limited to three, either.

As described above, in the left headlamp 100L of the second embodiment, in the light guide member 16L, thicknesses T1L, T2L, and T3L of portions through which the main optical paths C1L, C2L, and C3L corresponding to the first light source modules 13L, 14L, and 15L pass are set to values equivalent to each other. This allows the weight of the left headlamp 100L to be reduced and improves the quality of the first light distributing pattern PL. This is similarly applied to the right headlamp 100R as well.

Third Embodiment

Figure 14:
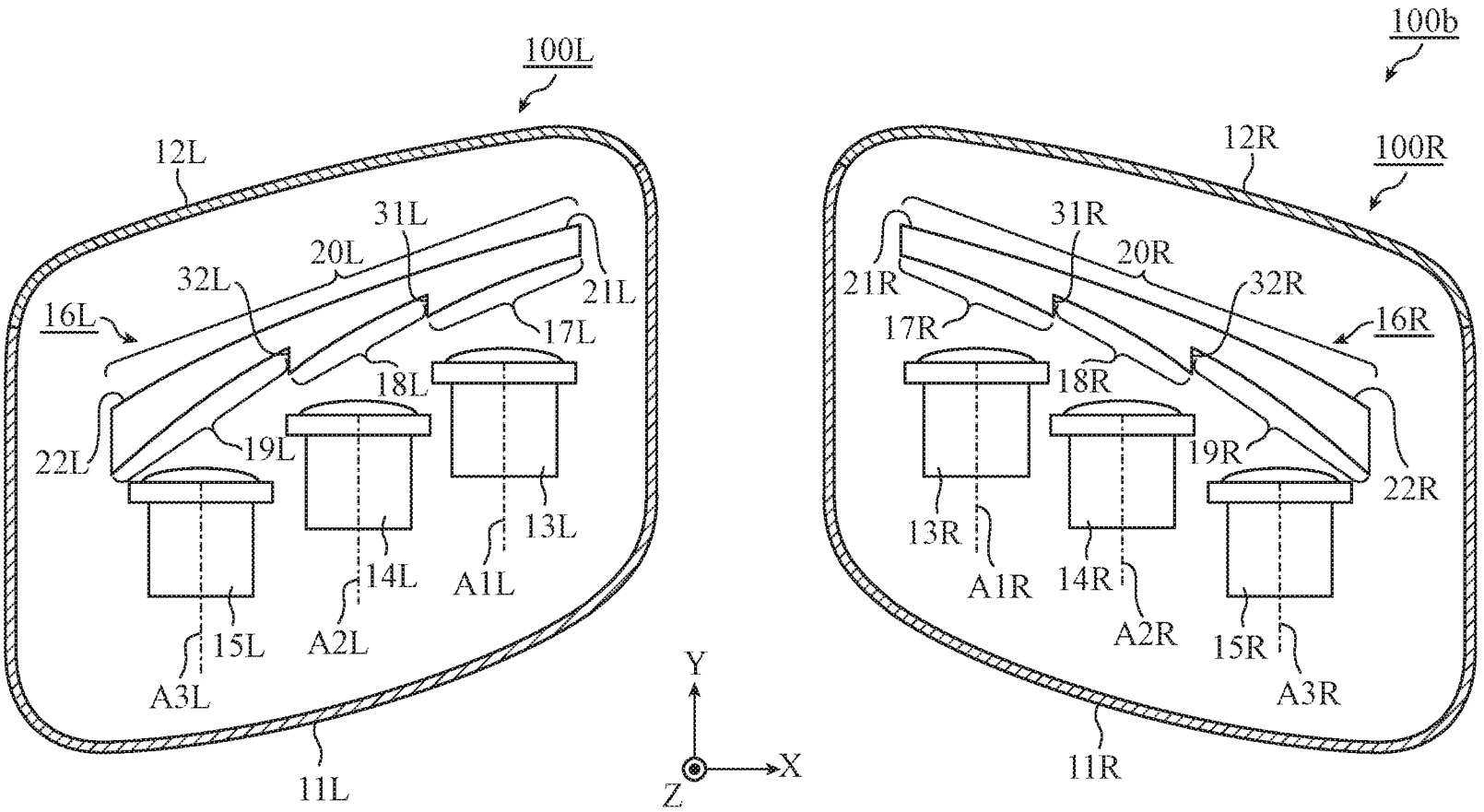
FIG. 14 is an explanatory view illustrating the main part of a headlamp according to a third embodiment of the present invention.
Figure 15A:
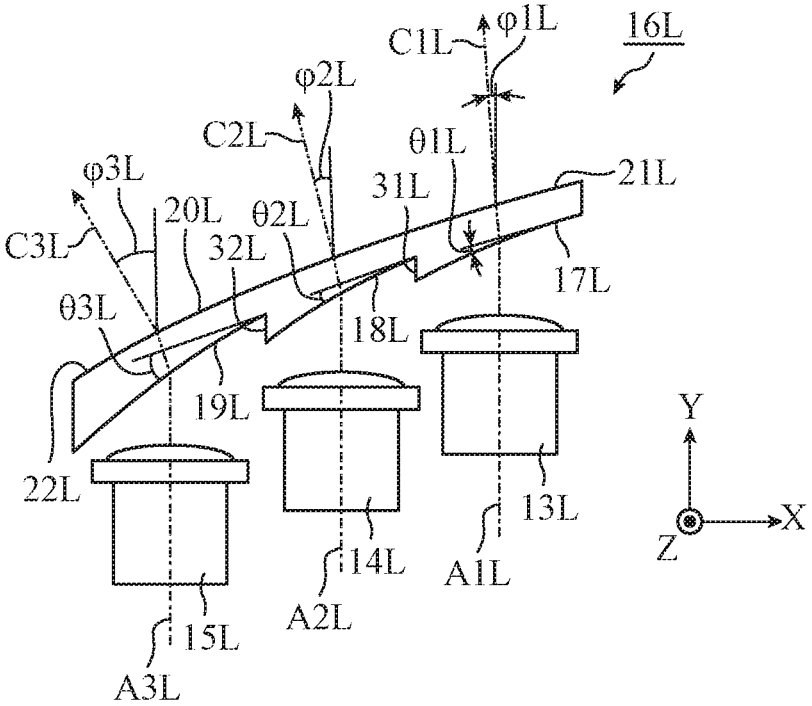
FIG. 15A is an explanatory view illustrating the main optical paths in a left headlamp illustrated in FIG. 14.
Figure 15B:
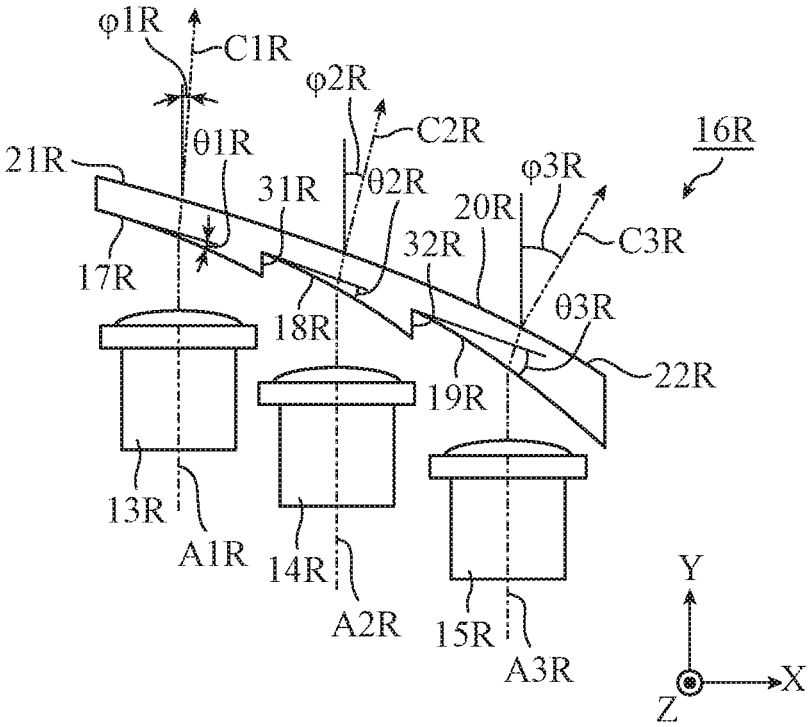
FIG. 15B is an explanatory view illustrating the main optical paths in a right headlamp illustrated in FIG. 14.

FIG. 14 is an explanatory view illustrating the main part of a headlamp according to a third embodiment of the present invention. FIG. 15A is an explanatory view illustrating the main optical paths in a left headlamp illustrated in FIG. 14. FIG. 15B is an explanatory view illustrating the main optical paths in a right headlamp illustrated in FIG. 14. With reference to FIGS. 14 and 15, a headlamp 100*b* of the third embodiment will be described. Note that a component or the like similar to that of the headlamp 100*a* of the second embodiment illustrated in FIGS. 12 and 13 is denoted by the same symbol, and description thereof will be omitted.

In the light guide member 16L of the second embodiment, as illustrated in FIG. 13A, each of the first incident surfaces 17L, 18L, and 19L is planar and the emitting surface 20L is also planar. On the other hand, in a light guide member 16L of the third embodiment, as illustrated in FIG. 15A, each of first incident surfaces 17L, 18L, and 19L is curved, and an emitting surface 20L is also curved. In the example illustrated in FIG. 15A, the first incident surfaces 17L, 18L, and 19L have substantially equivalent curvatures, and the emitting surface 20L also has a curvature substantially equivalent to those of the first incident surfaces 17L, 18L, and 19L.

Using a curved surface on the outer shape of the light guide member 16L facilitates adoption of a design mainly based on curved surfaces in a left headlamp 100L. As a result, the design flexibility of the left headlamp 100L can be improved.

A light guide member 16R has a similar shape to that of the light guide member 16L. That is, as illustrated in FIG. 15B, each of first incident surfaces 17R, 18R, and 19R of the light guide member 16R of the third embodiment has a curved surface, and an emitting surface 20R also has a curved surface. In the example illustrated in FIG. 15B, the first incident surfaces 17R, 18R, and 19R have curvatures substantially equivalent to each other, and the emitting surface 20R also has a curvature substantially equivalent to those of the first incident surfaces 17R, 18R, and 19R. As a result, the design flexibility of the right headlamp 100R can be improved.

Note that the headlamp 100*b* of the third embodiment can adopt various modifications similar to those described in the first and the second embodiments. For example, the number of first light source modules in the left headlamp 100L is not limited to three, and the number of first light source modules in the right headlamp 100R is not limited to three, either.

As described above, in the left headlamp 100L of the third embodiment, the first incident surfaces 17L, 18L, and 19L and the emitting surface 20L are curved. As a result, the design flexibility of the left headlamp 100L can be improved. This is similarly applied to the right headlamp 100R as well.

Fourth Embodiment

Figure 16:
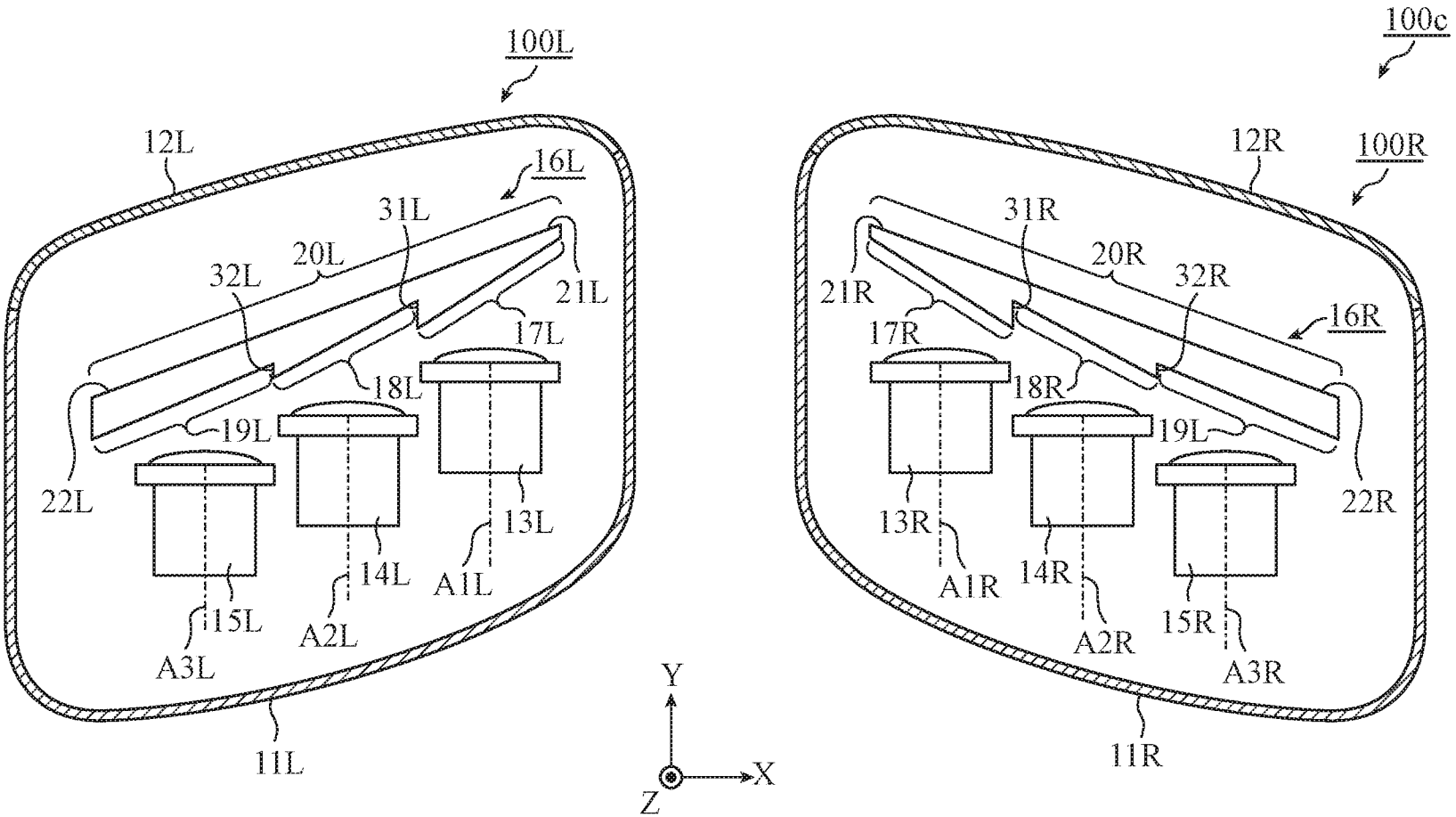
FIG. 16 is an explanatory view illustrating the main part of a headlamp according to a fourth embodiment of the present invention.
Figure 17A:
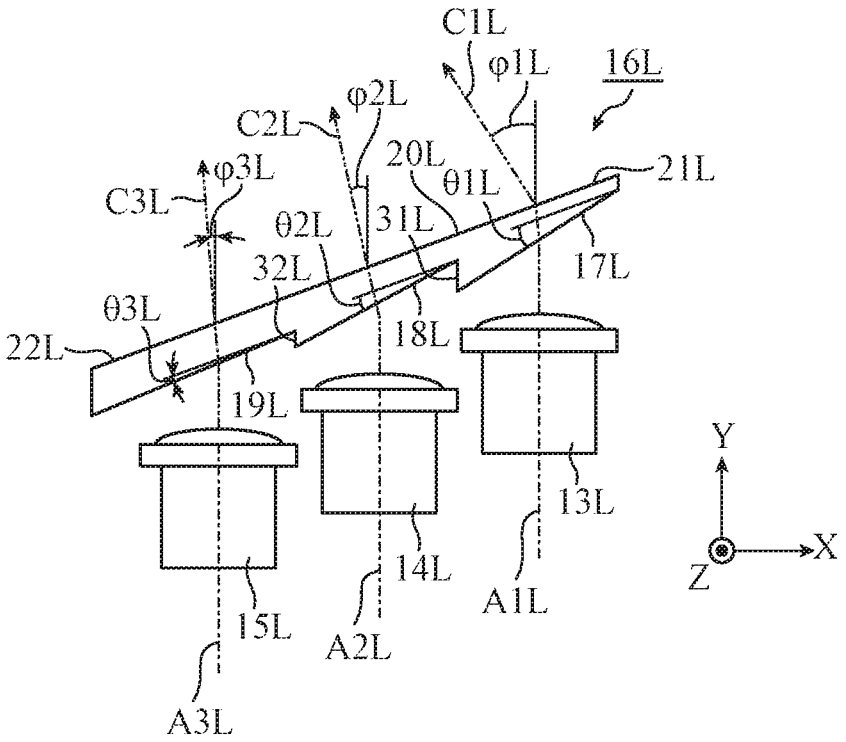
FIG. 17A is an explanatory view illustrating the main optical paths in a left headlamp illustrated in FIG. 16.
Figure 17B:
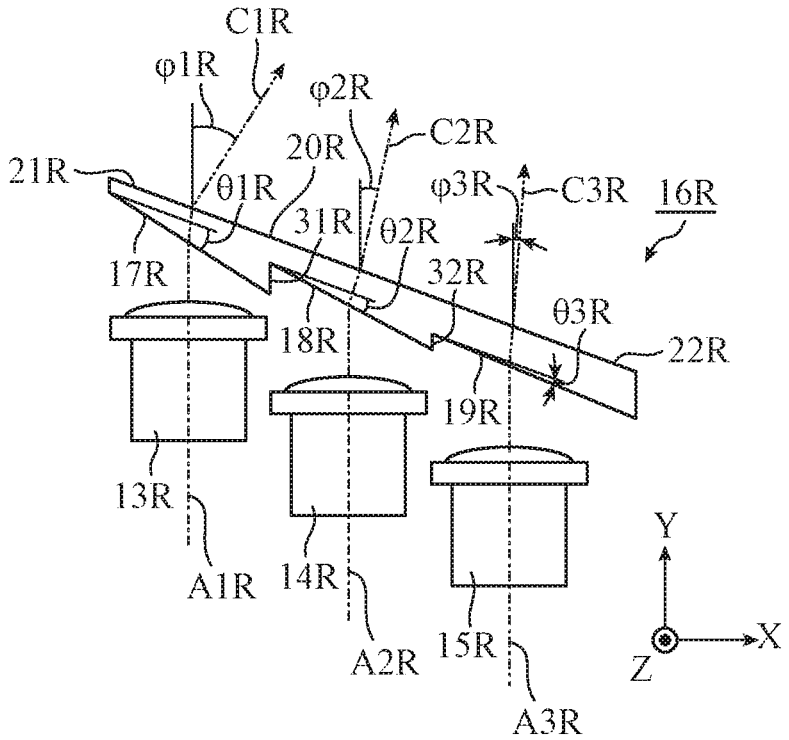
FIG. 17B is an explanatory view illustrating the main optical paths in a right headlamp illustrated in FIG. 16.

FIG. 16 is an explanatory view illustrating the main part of a headlamp according to a fourth embodiment of the present invention. FIG. 17A is an explanatory view illustrating the main optical paths in a left headlamp illustrated in FIG. 16. FIG. 17B is an explanatory view illustrating the main optical paths in a right headlamp illustrated in FIG. 16. With reference to FIGS. 16 and 17, a headlamp 100*c* of the fourth embodiment will be described. Note that a component or the like similar to that of the headlamp 100*a* of the second embodiment illustrated in FIGS. 12 and 13 is denoted by the same symbol, and description thereof will be omitted.

As illustrated in FIG. 13A, in the light guide member 16L of the second embodiment, the tilt angles θ1L, θ2L, and θ3L are set at values that gradually increase from the one end 21L toward the other end 22L of the emitting surface 20L, that is, from the inner side toward the outer side of the vehicle. Therefore, the emission angles φ1L, φ2L, and φ3L are set at values that gradually increase from the one end 21L toward the other end 22L of the emitting surface 20L, that is, from the inner side toward the outer side of the vehicle.

On the contrary, as illustrated in FIG. 17A, in a light guide member 16L of the fourth embodiment, tilt angles θ1L, θ2L, and θ3L are set at values that gradually decrease from one end 21L toward another end 22L of an emitting surface 20L, that is, from the inner side toward the outer side of the vehicle. Therefore, emission angles φ1L, φ2L, and φ3L are set at values that gradually decrease from the one end 21L toward the other end 22L of the emitting surface 20L, that is, from the inner side toward the outer side of the vehicle.

Accordingly, a left headlamp 100L of the fourth embodiment differs from the left headlamp 100L of the second embodiment in that the correspondence relationship between the first light source modules 13L, 14L, and 15L and the partial light distributing patterns P1L, P2L, and P3L is different. That is, in the first light distributing pattern PL illustrated in FIGS. 9 to 11, the first light source module 13L arranged on the inner side of the vehicle corresponds to the partial light distributing pattern P3L arranged on the outer side of the vehicle, the first light source module 15L arranged on the outer side of the vehicle corresponds to the partial light distributing pattern P1L arranged on the inner side of the vehicle, and the first light source module 14L arranged between the first light source modules 13L and 15L corresponds to the partial light distributing pattern P2L arranged between the partial light distributing patterns P3L and P1L.

In this manner, the correspondence relationship between the first light source modules 13L, 14L, and 15L and the partial light distributing patterns P1L, P2L, and P3L can be set as desired depending on the magnitude correlation of the tilt angles θ1L, θ2L, and θ3L. As a result, the design flexibility of the left headlamp 100L can be improved. Furthermore, since the optical action of the light guide member 16L varies depending on the magnitude correlation of the tilt angles θ1L, θ2L, and θ3L, it is possible to change the appearance of left headlamp 100L depending on whether each of the first light source modules 13L, 14L, and 15L is turned on or off. As a result, the left headlamp 100L that allows abundant variations in the appearance can be obtained.

Note that the magnitude correlation of the tilt angles θ1L, θ2L, and θ3L is not limited to θ1L<θ2L<θ3L of the second embodiment or θ1L>θ2L>θ3L of the fourth embodiment. In the case where three first light source modules 13L, 14L, and 15L are included in the left headlamp 100L, the magnitude correlation of the three tilt angles θ1L, θ2L, and θ3L may be set to any one of a total of six patterns of magnitude correlations.

For example, the magnitude correlation of the tilt angles θ1L, θ2L, and θ3L may be set to θ2L>θ1L>θ3L, θ2L>θ3L>θ1L, θ1L>θ3L>θ2L, or θ3L>θ1L>θ2L. In this case, the tilt angles θ1L, θ2L, and θ3L are set at values that irregularly vary from the one end 21L toward the other end 22L of the emitting surface 20L, that is, from the inner side toward the outer side of the vehicle.

A light guide member 16R has a similar shape to that of the light guide member 16L. That is, as illustrated in FIG. 17B, tilt angles θ1R, θ2R, and θ3R of a right headlamp 100R according to the fourth embodiment are set at values that gradually decrease from one end 21R toward another end 22R of an emitting surface 20R, that is, from the inner side toward the outer side of the vehicle. With this arrangement, in the right headlamp 100R of the fourth embodiment, in the first light distributing pattern PR illustrated in FIGS. 9 to 11, a first light source module 13R arranged on the inner side of the vehicle corresponds to the partial light distributing pattern P3R arranged on the outer side of the vehicle, a first light source module 15R arranged on the outer side of the vehicle corresponds to the partial light distributing pattern P1R arranged on the inner side of the vehicle, and a first light source module 14R arranged between the first light source modules 13R and 15R corresponds to the partial light distributing pattern P2R arranged between the partial light distributing patterns P3R and P1R.

In this manner, the correspondence relationship between the first light source modules 13R, 14R, and 15R and the partial light distributing patterns P1R, P2R, and P3R can be set as desired depending on the magnitude correlation of the tilt angles θ1R, θ2R, and θ3R. As a result, the design flexibility of the right headlamp 100R can be improved. Furthermore, since the optical action of the light guide member 16R varies depending on the magnitude correlation of the tilt angles θ1R, θ2R, and θ3R, it is possible to change the appearance of right headlamp 100R depending on whether each of the first light source modules 13R, 14R, and 15R is turned on or off. As a result, the right headlamp 100R that allows abundant variations in the appearance can be obtained.

Note that the magnitude correlation of the tilt angles θ1R, θ2R, and θ3R is not limited to θ1R<θ2R<θ3R of the second embodiment or θ1R>θ2R>θ3R of the fourth embodiment. For example, the magnitude correlation of the tilt angles θ1R, θ2R, and θ3R may be set to θ2R>θ1R>θ3R, θ2R>θ3R>θ1R, θ1R>θ3R>θ2R, or θ3R>θ1R>θ2R. In this case, the tilt angles θ1R, θ2R, and θ3R are set at values that vary irregularly from the one end 21R of the emitting surface 20R toward the other end 22R, that is, from the inner side to the outer side of the vehicle.

In addition, the headlamp 100*c* of the fourth embodiment can adopt various modifications similar to those described in the first to third embodiments. For example, the number of first light source modules in the left headlamp 100L is not limited to three, and the number of first light source modules in the right headlamp 100R is not limited to three, either. In the light guide member 16L, the first incident surfaces 17L, 18L, and 19L and the emitting surface 20L may have a curved shape. In the light guide member 16R, the first incident surfaces 17R, 18R, and 19R and the emitting surface 20R may have a curved shape.

As described above, in the left headlamp 100L of the fourth embodiment, the first incident surfaces 17L, 18L, and 19L are arrayed along the longitudinal direction of the emitting surface 20L, and the tilt angles θ1L, θ2L, and θ3L of the first incident surfaces 17L, 18L, and 19L with respect to the emitting surface 20L are set at values which gradually decrease from the one end 21L toward the other end 22L of the emitting surface 20L. Since the correspondence relationship between the first light source modules 13L, 14L, and 15L and the partial light distributing patterns P1L, P2L, and P3L can be set as desired depending on the magnitude correlation of the tilt angles θ1L, θ2L, and θ3L, the design flexibility of the left headlamp 100L can be improved. Furthermore, since the optical action of the light guide member 16L varies depending on the magnitude correlation of the tilt angles θ1L, θ2L, and θ3L, the left headlamp 100L that allows abundant variations in the appearance can be obtained. This is similarly applied to the right headlamp 100R as well.

Alternatively, in the left headlamp 100L of the fourth embodiment, the first incident surfaces 17L, 18L, and 19L are arrayed along the longitudinal direction of the emitting surface 20L, and the tilt angles θ1L, θ2L, and θ3L of the first incident surfaces 17L, 18L, and 19L with respect to the emitting surface 20L are set at values which irregularly vary from the one end 21L toward the other end 22L of the emitting surface 20L. Since the correspondence relationship between the first light source modules 13L, 14L, and 15L and the partial light distributing patterns P1L, P2L, and P3L can be set as desired depending on the magnitude correlation of the tilt angles θ1L, θ2L, and θ3L, the design flexibility of the left headlamp 100L can be improved. Furthermore, since the optical action of the light guide member 16L varies depending on the magnitude correlation of the tilt angles θ1L, θ2L, and θ3L, the left headlamp 100L that allows abundant variations in the appearance can be obtained. This is similarly applied to the right headlamp 100R as well.

Fifth Embodiment

Figure 18:
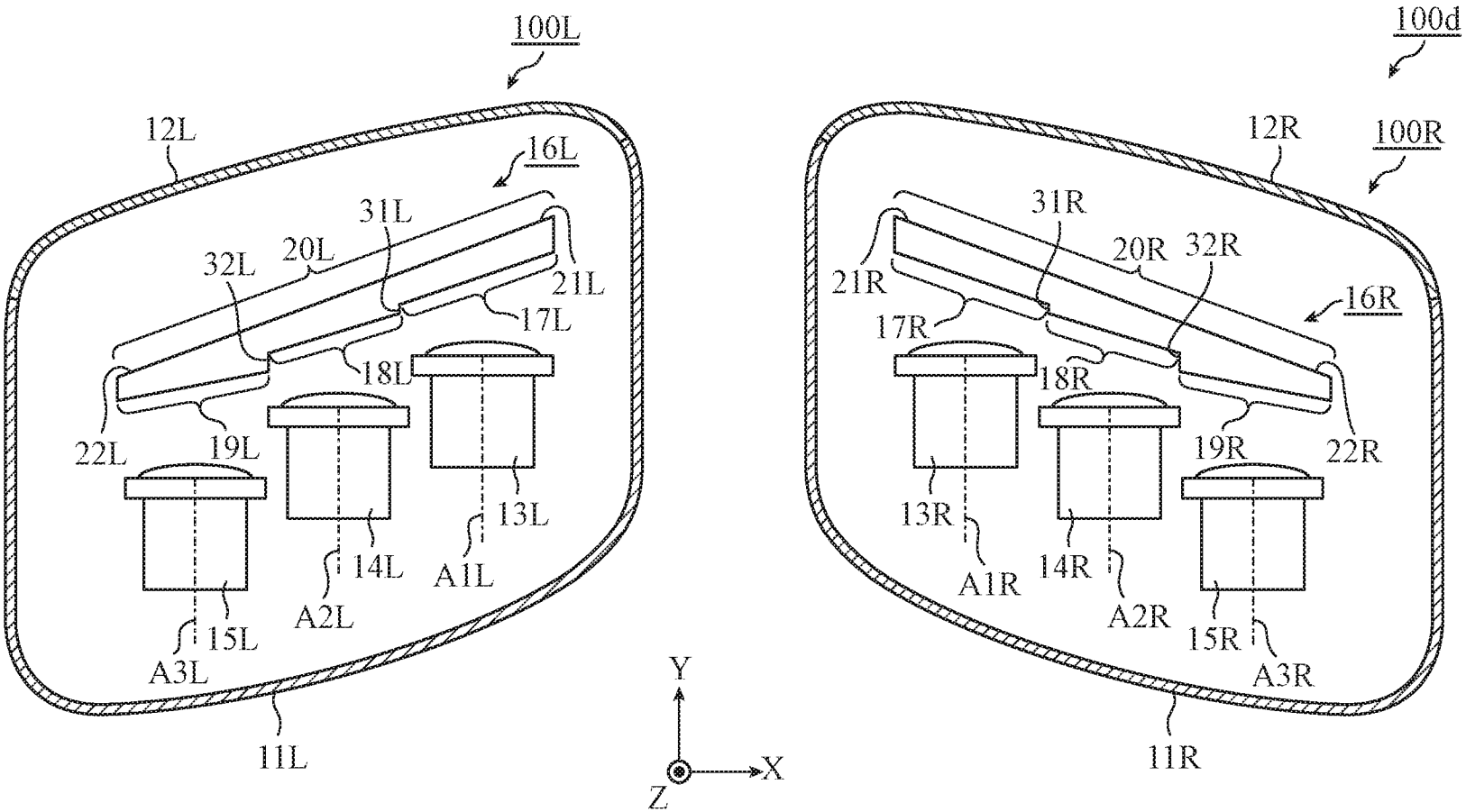
FIG. 18 is an explanatory view illustrating the main part of a headlamp according to a fifth embodiment of the present invention.
Figure 19A:
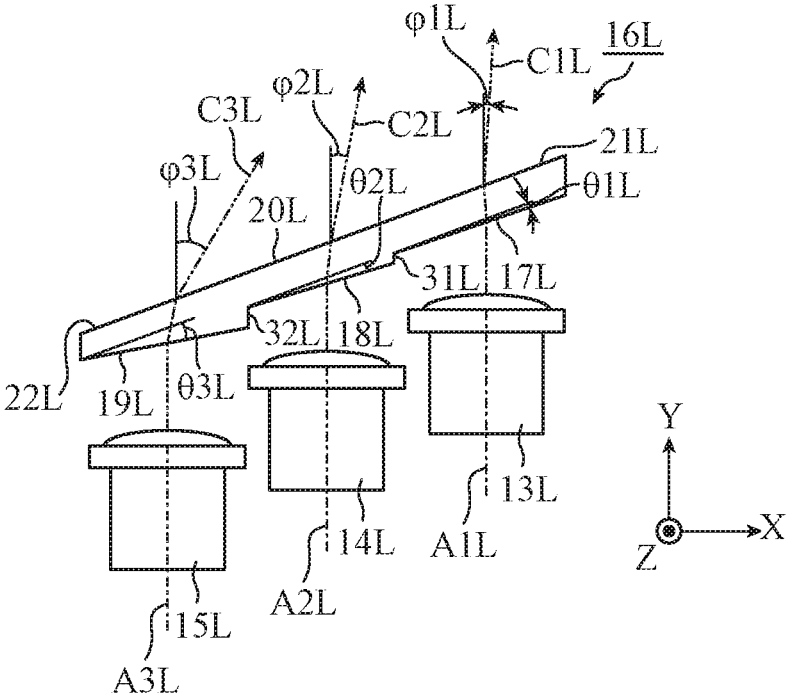
FIG. 19A is an explanatory view illustrating the main optical paths in a left headlamp illustrated in FIG. 18.
Figure 19B:
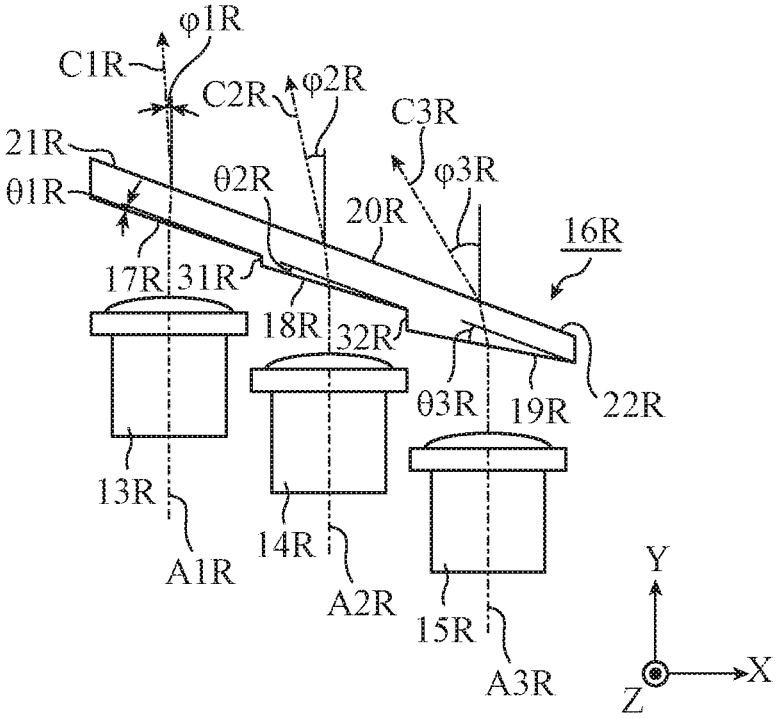
FIG. 19B is an explanatory view illustrating the main optical paths in a right headlamp illustrated in FIG. 18.

FIG. 18 is an explanatory view illustrating the main part of a headlamp according to a fifth embodiment of the present invention. FIG. 19A is an explanatory view illustrating the main optical paths in a left headlamp illustrated in FIG. 18. FIG. 19B is an explanatory view illustrating the main optical paths in a right headlamp illustrated in FIG. 18. With reference to FIGS. 18 and 19, a headlamp 100*d* of the fifth embodiment will be described. Note that a component or the like similar to that of the headlamp 100*a* of the second embodiment illustrated in FIGS. 12 and 13 is denoted by the same symbol, and description thereof will be omitted.

As illustrated in FIG. 13A, the portions of the light guide member 16L according to the second embodiment corresponding to the respective first incident surfaces 17L, 18L, and 19L are formed such that the thickness on the other end 22L side has a larger value than the thickness on the one end 21L side. Therefore, each of the tilt angles θ1L, θ2L, and θ3L is set to an angle in the counterclockwise direction with respect to the Z axis in the drawing, and each of the emission angles φ1L, φ2L, and φ3L is set in the counterclockwise direction with respect to the Z axis in the drawing.

On the other hand, as illustrated in FIG. 19A, portions of a light guide member 16L according to the fifth embodiment that correspond to respective first incident surfaces 17L, 18L, and 19L are set to have such values that, relative to the thickness on one end 21L side, the thickness on another end 22L side is thinner. That is, the respective portions are set to have such values that the thickness on the outer side of the vehicle is thinner than the thickness on the inner side of the vehicle. Therefore, each of the tilt angles θ1L, θ2L, and θ3L is set to an angle in the clockwise direction with respect to the Z axis in the drawing, and each of the emission angles φ1L, φ2L, and φ3L is set in the clockwise direction with respect to the Z axis in the drawing. As a result, the left headlamp 100L of the fifth embodiment forms the first light distributing pattern PR on the right half with respect to the vehicle.

In the example illustrated in FIG. 19A, the tilt angles θ1L, θ2L, and θ3L are set at values that gradually increase from the one end 21L toward the other end 22L of the emitting surface 20L, that is, from the inner side toward the outer side of the vehicle. Therefore, the emission angles φ1L, φ2L, and φ3L are set at values that gradually increase from the one end 21L toward the other end 22L of the emitting surface 20L, that is, from the inner side toward the outer side of the vehicle. Therefore, in the first light distributing pattern PR illustrated in FIGS. 9 to 11, a first light source module 13L arranged on the inner side of the vehicle corresponds to the partial light distributing pattern P1R arranged on the inner side of the vehicle, a first light source module 15L arranged on the outer side of the vehicle corresponds to the partial light distributing pattern P3R arranged on the outer side of the vehicle, and a first light source module 14L arranged between the first light source modules 13L and 15L corresponds to the partial light distributing pattern P2R arranged between the partial light distributing patterns P1R and P3R.

In this manner, the correspondence relationship between the left headlamp 100L and the first light distributing patterns PL and PR can be set as desired depending on the directions of the tilt angles θ1L, θ2L, and θ3L. As a result, the design flexibility of the left headlamp 100L can be improved. Furthermore, since the optical action of the light guide member 16L varies depending on the directions of the tilt angles θ1L, θ2L, and θ3L, it is possible to change the appearance of left headlamp 100L depending on whether each of the first light source modules 13L, 14L, and 15L is turned on or off. As a result, the left headlamp 100L that allows abundant variations in the appearance can be obtained.

A light guide member 16R has a similar shape to that of the light guide member 16L. That is, as illustrated in FIG. 19B, portions of the light guide member 16R according to the fifth embodiment corresponding to the respective first incident surfaces 17R, 18R, and 19R are set to have such values that, relative to the thickness on one end 21R side, the thickness on another end 22R side is thinner. Thus, each of the emission angles φ1R, φ2R, and φ3R is an angle in the clockwise direction with respect to the Z axis in the drawing. As a result, the right headlamp 100R of the fifth embodiment forms the first light distributing pattern PL on the left half with respect to the vehicle.

In the example illustrated in FIG. 19B, tilt angles θ1R, θ2R, and θ3R are set at values that gradually increase from the one end 21R toward the other end 22R of an emitting surface 20R, that is, from the inner side toward the outer side of the vehicle. Therefore, emission angles φ1R, φ2R, and φ3R are set at values that gradually increase from the one end 21R toward the other end 22R of the emitting surface 20R, that is, from the inner side toward the outer side of the vehicle. Therefore, in the first light distributing pattern PL illustrated in FIGS. 9 to 11, the first light source module 13R arranged on the inner side of the vehicle corresponds to the partial light distributing pattern P1L arranged on the inner side of the vehicle, the first light source module 15R arranged on the outer side of the vehicle corresponds to the partial light distributing pattern P3L arranged on the outer side of the vehicle, and the first light source module 14R arranged between the first light source modules 13R and 15R corresponds to the partial light distributing pattern P2L arranged between the partial light distributing patterns P1L and P3L.

In this manner, the correspondence relationship between the right headlamp 100R and the first light distributing patterns PL and PR can be set as desired depending on the directions of the tilt angles θ1R, θ2R, and θ3R. As a result, the design flexibility of the right headlamp 100R can be improved. Furthermore, since the optical action of the light guide member 16R varies depending on the directions of the tilt angles θ1R, θ2R, and θ3R, it is possible to change the appearance of right headlamp 100R depending on whether each of the first light source modules 13R, 14R, and 15R is turned on or off. As a result, the right headlamp 100R that allows abundant variations in the appearance can be obtained.

Note that the headlamp 100*d* of the fifth embodiment can adopt various modifications similar to those described in the first to fourth embodiments. For example, the number of the first light source modules in the left headlamp 100L is not limited to three, and the number of the first light source modules in the right headlamp 100R is not limited to three, either. In the light guide member 16L, the first incident surfaces 17L, 18L, and 19L and the emitting surface 20L may have a curved shape. In the light guide member 16R, the first incident surfaces 17R, 18R, and 19R and the emitting surface 20R may have a curved shape. The magnitude correlation of the tilt angles θ1L, θ2L, and θ3L is not limited to θ1L<θ2L<θ3L illustrated in FIG. 19A, and the magnitude correlation of the tilt angles θ1R, θ2R, and θ3R is not limited to θ1R<θ2R<θ3R illustrated in FIG. 19B, either.

As described above, in the left headlamp 100L of the fifth embodiment, the first incident surfaces 17L, 18L, and 19L are arrayed along the longitudinal direction of the emitting surface 20L, and the portions of the light guide member 16L that respectively correspond to the first incident surfaces 17L, 18L, and 19L are set to have such values that the thickness on the other end 22L side of the emitting surface 20L is thinner than the thickness on the one end 21L side of the emitting surface 20L. The directions of the tilt angles θ1L, θ2L, and θ3L vary depending on the thicknesses, and thus the correspondence relationship between the left headlamp 100L and the first light distributing patterns PL and PR can be set as desired depending on the directions of the tilt angles θ1L, θ2L, and θ3L. As a result, the design flexibility of the left headlamp 100L can be improved. Furthermore, since the optical action of the light guide member 16L varies depending on the directions of the tilt angles θ1L, θ2L, and θ3L, the left headlamp 100L that allows abundant variations in the appearance can be obtained. This is similarly applied to the right headlamp 100R as well.

Sixth Embodiment

Figure 20:
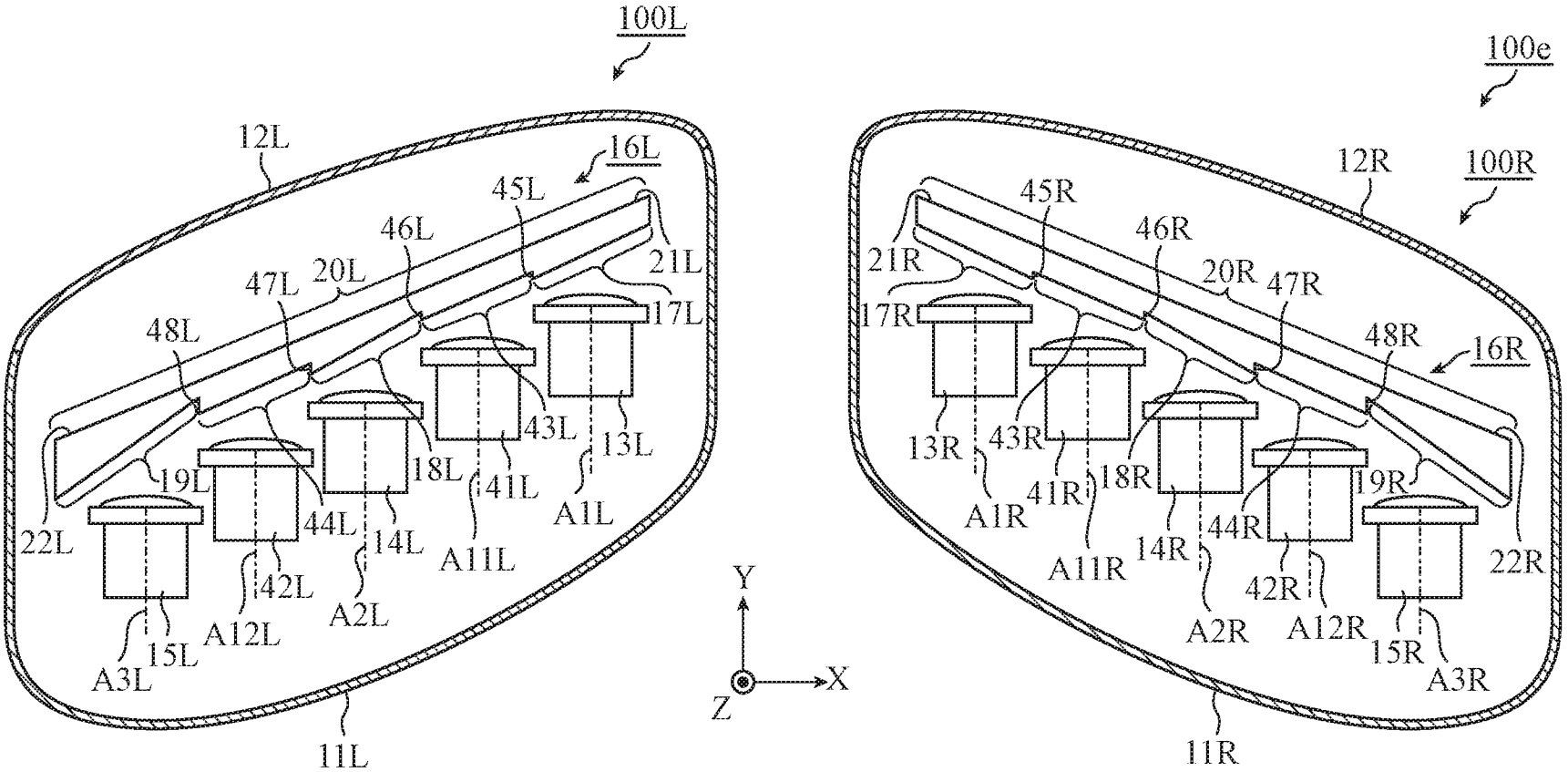
FIG. 20 is an explanatory view illustrating the main part of a headlamp according to a sixth embodiment of the present invention.
Figure 21A:
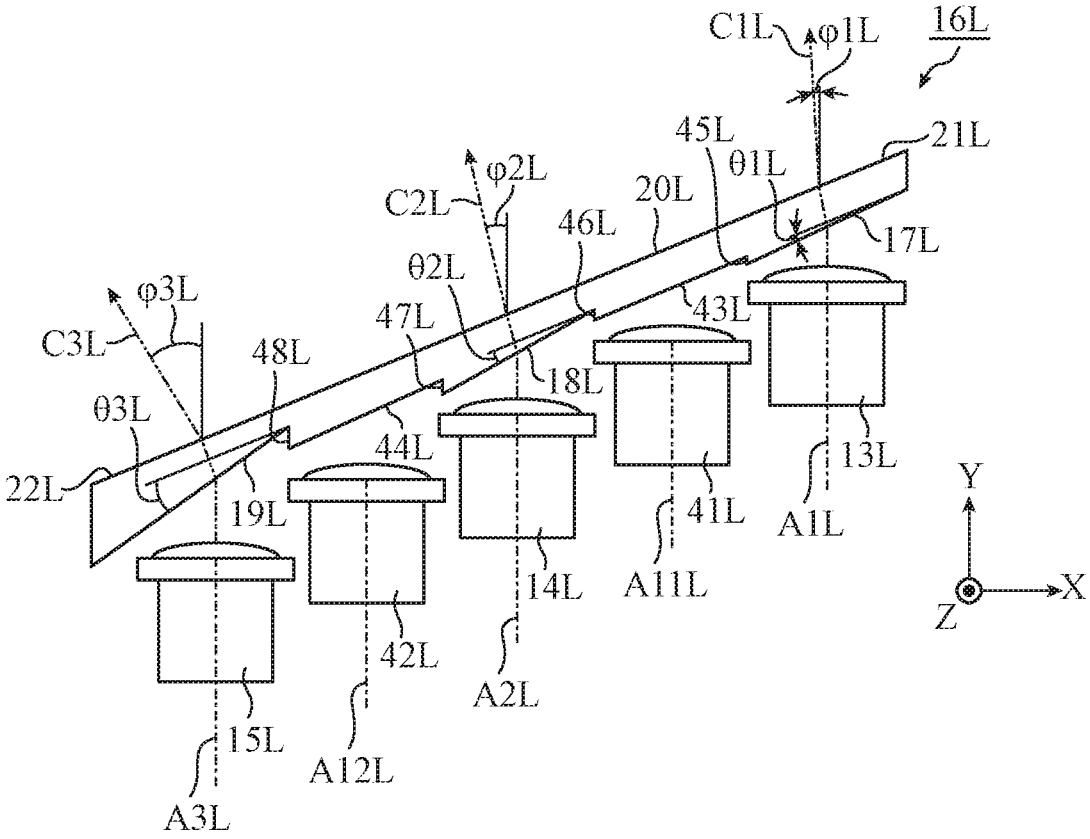
FIG. 21A is an explanatory view illustrating the main optical paths in a left headlamp illustrated in FIG. 20.
Figure 21B:
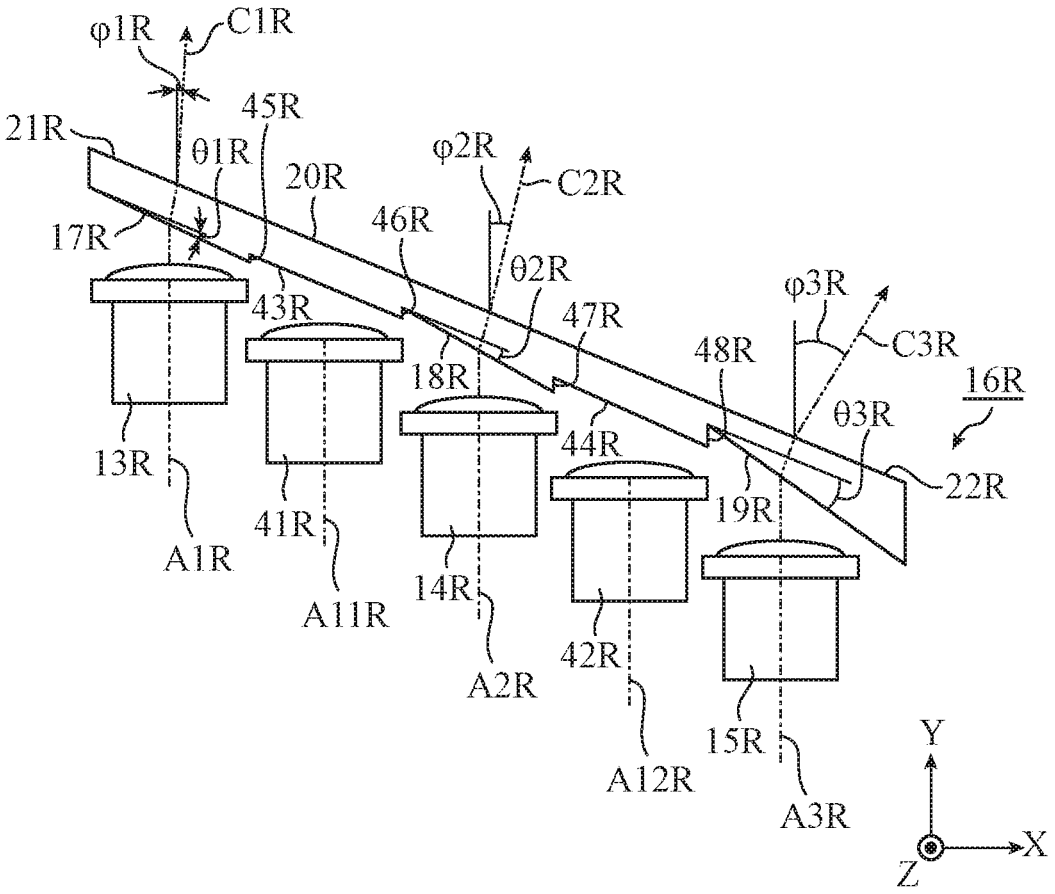
FIG. 21B is an explanatory view illustrating the main optical paths in a right headlamp illustrated in FIG. 20.

FIG. 20 is an explanatory view illustrating the main part of a headlamp according to a sixth embodiment of the present invention. FIG. 21A is an explanatory view illustrating the main optical paths in a left headlamp illustrated in FIG. 20. FIG. 21B is an explanatory view illustrating the main optical paths in a right headlamp illustrated in FIG. 20. With reference to FIGS. 20 and 21, a headlamp 100*e* of the sixth embodiment will be described. Note that a component or the like similar to that of the headlamp 100 of the first embodiment illustrated in FIGS. 7 and 8 is denoted by the same symbol, and description thereof will be omitted.

First, the left headlamp 100L will be described. One second light source module 41L is provided between first light source modules 13L and 14L adjacent to each other. Another second light source module 42L is further provided between first light source modules 14L and 15L adjacent to each other. Each of the second light source modules 41L and 42L has a similar structure to that of the light source module 10 illustrated in FIGS. 1 and 2, or has a similar structure to that of the light source module 10*a* illustrated in FIGS. 4 and 5.

Optical axes A11L and A12L of the second light source modules 41L and 42L are provided substantially parallel to optical axes A1L, A2L, and A3L of the first light source modules 13L, 14L, and 15L. As a result, the second light source modules 41L and 42L have light projection directions substantially parallel to light projection directions of the first light source modules 13L, 14L, and 15L.

The second light source modules 41L and 42L are used to form another light distributing pattern different from the first light distributing patterns PL and PR (hereinafter referred to as "second light distributing pattern"). The second light distributing pattern is, for example, a light distributing pattern for a passing headlamp (so-called "low beam") and a light distributing pattern for a travelling headlamp (so-called "high beam"). In this case, for example, in the second light source modules 41L and 42L, the second light source module 41L may correspond to the low-beam light distributing pattern and the second light source module 42L may correspond to the high-beam light distributing pattern.

In a light guide member 16L, one second incident surface 43L is formed between first incident surfaces 17L and 18L adjacent to each other, and one second incident surface 44L is formed between first incident surfaces 18L and 19L adjacent to each other. The second incident surfaces 43L and 44L correspond to the second light source modules 41L and 42L, respectively. The second incident surfaces 43L and 44L are arranged so as to face the second light source modules 41L and 42L, respectively.

An emitting surface 20L of the light guide member 16L is shared by all the first light source modules 13L, 14L, and 15L and all the second light source modules 41L and 42L and is arranged to face all the first incident surfaces 17L, 18L, and 19L and all of the second light source modules 41L and 42L.

Each of the second incident surfaces 43L and 44L is substantially parallel to the emitting surface 20L. Therefore, an emission angle (not illustrated) corresponding to light projected by each of the second light source modules 41L and 42L is approximately 0 degrees. That is, the emission direction is substantially parallel to the light projection direction.

In this example, in the light guide member 16L, a step surface 45L is formed between the first incident surface 17L and the second incident surface 43L that are adjacent to each other. Similarly, a step surface 46L is formed between the second incident surface 43L and the first incident surface 18L adjacent to each other, a step surface 47L is formed between the first incident surface 18L and the second incident surface 44L adjacent to each other, and a step surface 48L is formed between the second incident surface 44L and the first incident surface 19L adjacent to each other. By forming the step surfaces 45L, 46L, 47L, and 48L, the light guide member 16L can be thinned. As a result, the weight of the left headlamp 100L can be reduced.

With the arrangement that the emitting surface 20L is shared by the second light source modules 41L and 42L corresponding to the second light distributing pattern in addition to the first light source modules 13L, 14L, and 15L corresponding to the first light distributing pattern PL, the number of parts of the left headlamp 100L can be reduced to downsize the left headlamp 100L.

Furthermore, the arrangement of the first light source modules 13L, 14L, and 15L and the second light source modules 41L and 42L can be determined in consideration of the vibration resistance performance, the stability of orientation performance, the position of the center of gravity, heat dissipation characteristics, interference among parts, etc. in the entire left headlamp 100L including the second light source modules 41L and 42L, and also in consideration of the appearance of the left headlamp 100L with the left headlamp 100L turned on or off in accordance with each of the first light distributing pattern PL and the second light distributing pattern. As a result, the degree of flexibility of arrangement of the first light source modules 13L, 14L, and 15L and the second light source modules 41L and 42L can be improved, the degree of design flexibility of the left headlamp 100L can be improved, and a high-performance left headlamp 100L can be obtained.

Next, the right headlamp 100R will be described. The right headlamp 100R has a structure obtained by horizontally inverting the left headlamp 100L. That is, a second light source module 41R is provided between first light source modules 13R and 14R, and a second light source module 42R is provided between first light source modules 14R and 15R. Each of the second light source modules 41R and 42R has a similar structure to that of the light source module 10 illustrated in FIGS. 1 and 2, or has a similar structure to that of the light source module 10*a* illustrated in FIGS. 4 and 5. Optical axes A11R and A12R of the second light source modules 41R and 42R are provided substantially parallel to optical axes A1R, A2R, and A3R of the first light source modules 13R, 14R, and 15R.

The second light source modules 41R and 42R are used to form another light distributing pattern different from the first light distributing patterns PR (hereinafter referred to as "second light distributing pattern"). The second light distributing pattern is, for example, a light distributing pattern for low beam and a light distributing pattern for high beam.

In a light guide member 16R, a second incident surface 43R is formed between the first incident surfaces 17R and 18R, and a second incident surface 44R is formed between the first incident surfaces 18R and 19R. The second incident surfaces 43R and 44R correspond to the second light source modules 41R and 42R, respectively. The second incident surfaces 43R and 44R are arranged so as to face the second light source modules 41R and 42R, respectively.

An emitting surface 20R of the light guide member 16R is shared by all the first light source modules 13R, 14R, and 15R and all the second light source modules 41R and 42R and is arranged to face all the first incident surfaces 17R, 18R, and 19R and all of the second incident surfaces 43R and 44R. Each of the second incident surfaces 43R and 44R is substantially parallel to the emitting surface 20R.

In this example, in the light guide member 16R, a step surface 45R formed between the first incident surface 17R and the second incident surface 43R, a step surface 46R is formed between the second incident surface 43R and the first incident surface 18R, a step surface 47R is formed between the first incident surface 18R and the second incident surface 44R, and a step surface 48R is formed between the second incident surface 44R and the first incident surface 19R. By forming the step surfaces 45R, 46R, 47R, and 48R, the light guide member 16R can be thinned. As a result, the weight of the right headlamp 100R can be reduced.

With the arrangement that the emitting surface 20R is shared by the second light source modules 41R and 42R corresponding to the second light distributing pattern in addition to the first light source modules 13R, 14R, and 15R corresponding to the first light distributing pattern PR, the number of parts of the right headlamp 100R can be reduced to downsize the right headlamp 100R.

Furthermore, the arrangement of the first light source modules 13R, 14R, and 15R and the second light source modules 41R and 42R can be determined in consideration of the vibration resistance performance, the stability of orientation performance, the position of the center of gravity, heat dissipation characteristics, interference among parts, etc. in the entire right headlamp 100R including the second light source modules 41R and 42R, and also in consideration of the appearance of the right headlamp 100R with the right headlamp 100R turned on or off in accordance with each of the first light distributing pattern PR and the second light distributing pattern. As a result, the degree of flexibility of arrangement of the first light source modules 13R, 14R, and 15R and the second light source modules 41R and 42R can be improved, the degree of design flexibility of the right headlamp 100R can be improved, and a high-performance right headlamp 100R can be obtained.

Note that the light projection directions of the second light source modules 41L and 42L are only required to be substantially parallel to the light projection directions of the first light source modules 13L, 14L, and 15L, and may not be completely parallel to them. Similarly, the light projection directions of the second light source modules 41R and 42R are only required to be substantially parallel to the light projection directions of the first light source modules 13R, 14R, and 15R, and may not be completely parallel to them. The meaning of the term "parallel" described herein is not limited to a completely parallel state but also includes a substantially parallel state.

In the example illustrated in FIG. 21A, the second incident surfaces 43L and 44L are only required to be substantially parallel to the emitting surface 20L, and may not be completely parallel thereto. Similarly, in the example illustrated in FIG. 21B, the second incident surfaces 43R and 44R are only required to be substantially parallel to the emitting surface 20R, and may not be completely parallel to it. The meaning of the term "parallel" described herein is not limited to a completely parallel state but also includes a substantially parallel state.

In addition, the second incident surfaces 43L and 44L may not be parallel to the emitting surface 20L, that is, may have a predetermined tilt angle (not illustrated). Similarly, the second incident surfaces 43R and 44R may not be parallel to the emitting surface 20R, that is, may have a predetermined tilt angle (not illustrated).

Moreover, the arrangement positions of the second light source modules 41L and 42L in the left headlamp 100L is not limited to the positions between the first light source modules 13L, 14L, and 15L. For example, the second light source modules 41L and 42L may be arranged on the inner side of the vehicle with respect to the first light source module 13L or on the outer side of the vehicle with respect to the first light source module 15L. This is similarly applied to the right headlamp 100R as well.

Moreover, the number of the second light source modules in the left headlamp 100L is not limited to two. The left headlamp 100L may include one or more second light source modules without limitation to the number of modules. This is similarly applied to the right headlamp 100R as well.

In addition, the headlamp 100*e* of the sixth embodiment can adopt various modifications similar to those described in the first to fifth embodiments. For example, the number of the first light source modules in the left headlamp 100L is not limited to three, and the number of the first light source modules in the right headlamp 100R is not limited to three. In the light guide member 16L, the first incident surfaces 17L, 18L, and 19L and the emitting surface 20L may have a curved shape. In the light guide member 16R, the first incident surfaces 17R, 18R, and 19R and the emitting surface 20R may have a curved shape. The magnitude correlation of the tilt angles θ1L, θ2L, and θ3L is not limited to θ1L<θ2L<θ3L illustrated in FIG. 21A, and the magnitude correlation of the tilt angles θ1R, θ2R, and θ3R is not limited to θ1R<—02R<θ3R illustrated in FIG. 21B. The left headlamp 100L may form the first light distributing pattern PR forming the right half, and the right headlamp 100R may form the first light distributing pattern PL forming the left half.

As described above, the left headlamp 100L of the sixth embodiment includes the second light source modules 41L and 42L having light projection directions parallel to the light projection directions of the first light source modules 13L, 14L, and 15L. The light guide member 16L has: the second incident surfaces 43L and 44L arranged so as to face the second light source modules 41L and 42L and corresponding to the second light source modules 41L and 42L, respectively; and the emitting surface 20L arranged so as to face the first incident surfaces 17L, 18L, and 19L and the second incident surfaces 43L and 44L and shared by the first light source modules 13L, 14L, and 15L and the second light source modules 41L and 42L. The second incident surfaces 43L and 44L are parallel to the emitting surface 20L. As a result, the left headlamp 100L that is small-sized, high-performing, high flexibility of arrangement of the first light source modules 13L, 14L, and 15L and the second light source modules 41L and 42L, and high design flexibility can be obtained. This is similarly applied to the right headlamp 100R as well.

Note that, within the scope of the present invention, the present invention may include a flexible combination of the embodiments, a modification of any component of the embodiments, or an omission of any component in the embodiments.

INDUSTRIAL APPLICABILITY

A headlamp of the present invention is applicable to vehicles such as automobiles.

REFERENCE SIGNS LIST

1: Housing, 2: Light source, 3: First optical system, 4: Light emitting surface, 5: Second optical system, 6: Diaphragm, 7: Through hole, 10 and 10*a*: Light source module, 11L and 11R: Main body case, 12L and 12R: Cover lens, 13L and 13R: First light source module, 14L and 14R: First light source module, 15L and 15R: First light source module, 16L and 16R: Light guide member, 17L and 17R: First incident surface, 18L and 18R: First incident surface, 19L and 19R: First incident surface, 20L and 20R: Emitting surface, 21L and 21R: One end, 22L and 22R: Another end, 31L and 31R: Step surface, 32L and 32R: Step surface, 41L and 41R: Second light source module, 42L and 42R: Second light source module, 43L and 43R: Second incident surface, 44L and 44R: Second incident surface, 45L and 45R: Step surface, 46L and 46R: Step surface, 47L and 47R: Step surface, 48L and 48R: Step surface, 100L: Left headlamp, 100R: Right headlamp, 100, 100*a*, 100*b*, 100*c*, 100*d*, and 100*e*: Headlamp.

The invention claimed is:

1. A vehicular headlamp capable of freely forming a light distributing pattern for a light distribution variable type headlamp by using a combination of partial light distributing patterns, the vehicular headlamp comprising:

first light source modules corresponding to the partial light distributing patterns and having light projection directions parallel to each other;

a second light source module having a light projection direction parallel to light projection directions of the first light source modules; and a light guide member having: first incident surfaces, arranged so as to face the first light source modules and corresponding to the first light source modules; a second incident surface, arranged so as to face the second light source module and corresponding to the second light source module; and an emitting surface, arranged so as to face the first incident surfaces and the second incident surface and shared by the first light source modules and the second light source module, the light guide member forming the light distributing pattern by deflecting light projected by the first light source modules, wherein the first incident surfaces are set to have tilt angles with respect to the emitting surface and different from each other, and the second incident surface is parallel to the emitting surface.

2. The vehicular headlamp according to claim 1, wherein the first incident surfaces are arrayed along a longitudinal direction of the emitting surface, and the tilt angles of the first incident surfaces with respect to the emitting surface are set to values gradually increasing from one end toward another end of the emitting surface or values gradually decreasing from the one end toward the other end of the emitting surface.

3. The vehicular headlamp according to claim 1, wherein, in the light guide member, thicknesses of portions through which main optical paths corresponding to the first light source modules pass are set to values equivalent to each other.

4. The vehicular headlamp according to claim 1, wherein the first incident surfaces and the emitting surface are curved.

5. The vehicular headlamp according to claim 1, wherein the first incident surfaces are arrayed along a longitudinal direction of the emitting surface, and portions of the light guide member respectively corresponding to the first incident surfaces are set to have thicknesses such that, relative to a thickness on one end side of the emitting surface, a thickness on another one end side of the emitting surface has a smaller value.

6. The vehicular headlamp according to claim 1, wherein the first incident surfaces are arrayed along a longitudinal direction of the emitting surface, and the tilt angles of the first incident surfaces with respect to the emitting surface are set to values irregularly varying from one end toward another end of the emitting surface.

* * * * *